US010597592B2

(12) United States Patent
Kandel et al.

(10) Patent No.: US 10,597,592 B2
(45) **Date of Patent: *Mar. 24, 2020**

(54) UPGRADING HYDROCARBON PYROLYSIS TAR

(71) Applicant: ExxonMobil Chemical Patents Inc., Baytown, TX (US)

(72) Inventors: Kapil Kandel, Humble, TX (US); Reyyan Koc-Karabocek, Houston, TX (US); Teng Xu, Houston, TX (US); Frank Cheng-Yu Wang, Annandale, NJ (US); David Thomas Ferrughelli, Easton, PA (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 175 days.

This patent is subject to a terminal disclaimer.

(21) Appl. No.: 15/667,045

(22) Filed: Aug. 2, 2017

(65) Prior Publication Data

US 2018/0057759 A1 Mar. 1, 2018

Related U.S. Application Data

(60) Provisional application No. 62/380,538, filed on Aug. 29, 2016.

(51) Int. Cl.
*C10G 69/06* (2006.01)

(52) U.S. Cl.
CPC ..... *C10G 69/06* (2013.01); *C10G 2300/301* (2013.01); *C10G 2300/302* (2013.01); *C10G 2300/308* (2013.01)

(58) Field of Classification Search
CPC ..... C10G 69/06; C10G 2300/301; C10G 2300/302; C10G 2300/308
See application file for complete search history.

(56) References Cited

U.S. PATENT DOCUMENTS

| | | | | |
|---|---|---|---|---|
| 5,871,634 | A | 2/1999 | Wiehe et al. | |
| 9,637,694 | B2 * | 5/2017 | Evans | C10G 9/36 |
| 2015/0315496 | A1 | 11/2015 | Soultanidis et al. | |
| 2015/0368570 | A1 | 12/2015 | Beech, Jr. et al. | |

(Continued)

FOREIGN PATENT DOCUMENTS

| | | | |
|---|---|---|---|
| EP | 2751234 | B | 11/2016 |
| WO | 2013/033577 | A | 3/2013 |

(Continued)

OTHER PUBLICATIONS

Fabuss, B.M., et al. "Thermal Cracking of Pure Saturated Hydrocarbons", Adv. Pet. Chem., Ref 9, Chapter 4, pp. 157-201, 1964.

(Continued)

*Primary Examiner* — Brian A McCaig

(57) ABSTRACT

A process is described for upgrading pyrolysis tar, such as steam cracker tar, by hydroprocessing in the presence of a utility fluid. The hydroprocessing conditions comprise a pressure >8 MPa and a weight hourly space velocity of combined pyrolysis tar and utility fluid >0.3 $hr^{-1}$ and are selected so that the hydrogen consumption rate is in the range of 270 to 445 standard cubic meters/cubic meter (S $m^3/m^3$) of pyrolysis tar.

27 Claims, 14 Drawing Sheets

(56) References Cited

U.S. PATENT DOCUMENTS

| | | | | |
|---|---|---|---|---|
| 2016/0122667 | A1 | 5/2016 | Evans et al. | |
| 2016/0177205 | A1* | 6/2016 | Evans | C10G 69/02 208/57 |

FOREIGN PATENT DOCUMENTS

| | | | |
|---|---|---|---|
| WO | 2013/033580 | A | 3/2013 |
| WO | 2013/033590 | A | 3/2013 |

OTHER PUBLICATIONS

Ford, T.J. "Liquid-Phase Thermal Decomposition of Hexadecane: Reaction Mechanisms", Ind. Eng. Chem. Fundarn. vol. 25, pp. 240-243, 1986.

Kissin, Y.V., "Free-Radical Reactions of High Molecular Weight Isoalkanes", Ind. Eng. Chem. Res. vol. 26, pp. 1633-1638, 1987.

Kossiakoff, A., et al. "Thermal Decomposition of Hydrocarbons, Resonance Stabilization and isomerization of Free Radicals", Journal of American Chemical Society, vol. 65, pp. 590-595, 1943.

* cited by examiner

UPGRADING HYDROCARBON PYROLYSIS TAR

PRIORITY CLAIM

This application claims priority to U.S. Provisional Application 62/380,538 which was filed Aug. 29, 2016, the disclosures of which are incorporated herein by reference.

FIELD

This invention relates to a process for upgrading pyrolysis tar, such as steam cracker tar, to the resulting upgraded pyrolysis tar product and to use of the upgraded pyrolysis tar product.

BACKGROUND

Pyrolysis processes, such as steam cracking, are utilized for converting saturated hydrocarbons to higher-value products such as light olefins, e.g., ethylene and propylene. Besides these useful products, hydrocarbon pyrolysis can also produce a significant amount of relatively low-value heavy products, such as pyrolysis tar. When the pyrolysis is conducted by steam cracking, the pyrolysis tar is identified as steam-cracker tar ("SCT").

Pyrolysis tar is a high-boiling, viscous, reactive material comprising complex, ringed and branched molecules that can polymerize and foul equipment. Pyrolysis tar also contains high molecular weight non-volatile components including paraffin insoluble compounds, such as pentane insoluble compounds and heptane-insoluble compounds. Particularly challenging pyrolysis tars contain >1 wt % toluene insoluble compounds. The high molecular weight compounds are typically multi-ring structures that are also referred to as tar heavies ("TH"). These high molecular weight molecules can be generated during the pyrolysis process, and their high molecular weight leads to high viscosity which limits desirable pyrolysis tar disposition options. For example, it is desirable to find higher-value uses for SCT, such as for fluxing with heavy hydrocarbons, especially heavy hydrocarbons of relatively high viscosity. It is also desirable to be able to blend SCT with one or more heavy oils, examples of which include bunker fuel, burner oil, heavy fuel oil (e.g., No. 5 or No. 6 fuel oil), high-sulfur fuel oil, low-sulfur oil, regular-sulfur fuel oil ("RSFO"), Emission Controlled Area (ECA) fuel with <0.1 wt % sulfur and the like.

One difficulty encountered when blending heavy hydrocarbons is fouling that results from precipitation of high molecular weight molecules, such as asphaltenes. See, e.g., U.S. Pat. No. 5,871,634, which is incorporated herein by reference in its entirety. In order to mitigate asphaltene precipitation, an Insolubility Number, $I_N$, and a Solvent Blend Number, $S_{BN}$, are determined for each blend component. Successful blending is accomplished with little or substantially no precipitation by combining the components in order of decreasing $S_{BN}$, so that the $S_{BN}$ of the blend is greater than the $I_N$ of any component of the blend. Pyrolysis tars generally have high $S_{BN}$>135 and high $I_N$>80 making them difficult to blend with other heavy hydrocarbons. Pyrolysis tars having $I_N$>100, e.g., >110, e.g., >130, are particularly difficult to blend without phase separation occurring.

Attempts at pyrolysis tar hydroprocessing to reduce viscosity and improve both $I_N$ and $S_{BN}$ have not led to a commercializable process, primarily because fouling of process equipment could not be substantially mitigated. For example, neat SCT hydroprocessing results in rapid catalyst coking when the hydroprocessing is carried out at a temperature in the range of about 250° C. to 380° C., a pressure in the range of about 5400 kPa to 20,500 kPa, using a conventional hydroprocessing catalyst containing one or more of Co, Ni, or Mo. This coking has been attributed to the presence of TH in the SCT that leads to the formation of undesirable deposits (e.g., coke deposits) on the hydroprocessing catalyst and the reactor internals. As the amount of these deposits increases, the yield of the desired upgraded pyrolysis tar (upgraded SCT) decreases and the yield of undesirable byproducts increases. The hydroprocessing reactor pressure drop also increases, often to a point where the reactor is inoperable.

One approach taken to overcome these difficulties is disclosed in International Patent Application Publication No. WO 2013/033580, which is incorporated herein by reference in its entirety. The application discloses hydroprocessing SCT in the presence of a utility fluid comprising a significant amount of single and multi-ring aromatics to form an upgraded pyrolysis tar product. The upgraded pyrolysis tar product generally has a decreased viscosity, decreased atmospheric boiling point range, and increased hydrogen content over that of the SCT feedstock, resulting in improved compatibility with fuel oil and blend-stocks. Additionally, efficiency advances involving recycling a portion of the upgraded pyrolysis tar product as utility fluid are described in International Patent Application Publication No. WO 2013/033590 also incorporated herein by reference in its entirety.

U.S. Published Patent Application No. 2015/0315496, which is incorporated herein by reference in its entirety, describes separating and recycling a mid-cut utility fluid from the upgraded pyrolysis tar product. The utility fluid comprises ≥10.0 wt % aromatic and non-aromatic ring compounds and each of the following: (a) ≥1.0 wt % of 1.0 ring class compounds; (b) ≥5.0 wt % of 1.5 ring class compounds; (c) ≥5.0 wt % of 2.0 ring class compounds; and (d) ≥0.1 wt % of 5.0 ring class compounds.

U.S. Published Patent Application No. 2015/0368570, which is incorporated herein by reference in its entirety, describes separating and recycling a utility fluid from the upgraded pyrolysis tar product. The utility fluid contains 1-ring and/or 2-ring aromatics and has a final boiling point ≤430° C.

U.S. Published Patent Application No. 2016/0122667, which is incorporated herein by reference in its entirety, describes a process for upgrading pyrolysis tar, such as steam cracker tar, in the presence of a utility fluid which contains 2-ring and/or 3-ring aromatics and has solubility blending number ($S_{BN}$)≥120.

Despite these advances, there remains a need for further improvements in the hydroprocessing of pyrolysis tars, especially those having high $I_N$ values, which allow the production of upgraded tar product having lower viscosity and density specifications without compromising the lifetime of the hydroprocessing reactor.

SUMMARY

When hydroprocessing pyrolysis tars, especially those having an incompatibility number ($I_N$) ≥110, in the presence of a utility fluid, it has been discovered that a beneficial decrease in reactor plugging can be achieved by operating under temperature and pressure conditions that achieve, with the particular catalyst employed, a molecular hydrogen consumption rate is in the range of 1600 to 2400 standard cubic feet (SCF) of hydrogen per barrel of pyrolysis tar (270 standard cubic meters of hydrogen/cubic meter of pyrolysis tar (S $m^3/m^3$) to about 445 S $m^3/m^3$). It has been discovered that this can be achieved by operating the hydroprocessing reaction zone at a pressure >8 MPa and a weight hourly space velocity of combined pyrolysis tar and utility fluid >0.3 $hr^{-1}$.

While not wishing to be bound by any theory or model, it is believed that maintaining the molecular hydrogen consumption rate within the range of 1600 to 2400 SCF per barrel of pyrolysis tar results in significant reduction in the density and/or viscosity of the pyrolysis tar without excessive saturation of aromatic rings that can lead to undesirable reduction in the $S_{BN}$ of the upgraded hydroprocessed tar product. In certain aspects, the density of the upgraded tar product measured at 15° C. is at least 0.10 g/$cm^3$ less than the density of the raw pyrolysis tar (before hydroprocessing). In certain aspects the viscosity of the upgraded tar product measured at 50° C. is <200 cSt.

Accordingly, one aspect of the invention relates to a hydrocarbon conversion process comprising several steps. First, provide a pyrolysis feedstock comprising ≥10.0 wt. % hydrocarbon based on the weight of the pyrolysis feedstock. Second, pyrolyze the pyrolysis feedstock to produce a pyrolysis effluent comprising pyrolysis tar and ≥1.0 wt. % of $C_2$ unsaturates, based on the weight of the pyrolysis effluent. Third, separate at least a portion of the pyrolysis tar from the pyrolysis effluent. Fourth, combine at least a portion of the separated pyrolysis tar with a utility fluid. The utility fluid comprises aromatic hydrocarbons and having an ASTM D86 10% distillation point ≥60° C. and a 90% distillation point ≤425° C. Fifth, hydroprocess the combined pyrolysis tar and utility fluid in at least one hydroprocessing zone in the presence of treatment gas comprising molecular hydrogen under catalytic hydroprocessing conditions to produce a hydroprocessed effluent comprising hydroprocessed tar, wherein the hydroprocessing conditions are selected such that the molecular hydrogen consumption rate is in the range of 270 to 445 standard cubic meters/cubic meter (S $m^3/m^3$) of pyrolysis tar.

In another aspect of the invention, there is provided a hydrocarbon conversion process wherein the hydroprocessing conditions comprise a pressure >8 MPa and a weight hourly space velocity of combined pyrolysis tar and utility fluid >0.3 $hr^{-1}$.

BRIEF DESCRIPTION OF THE DRAWINGS

The drawings are for illustrative purposes only and are not intended to limit the scope of the present invention.

BRIEF DESCRIPTION

Figure 1:
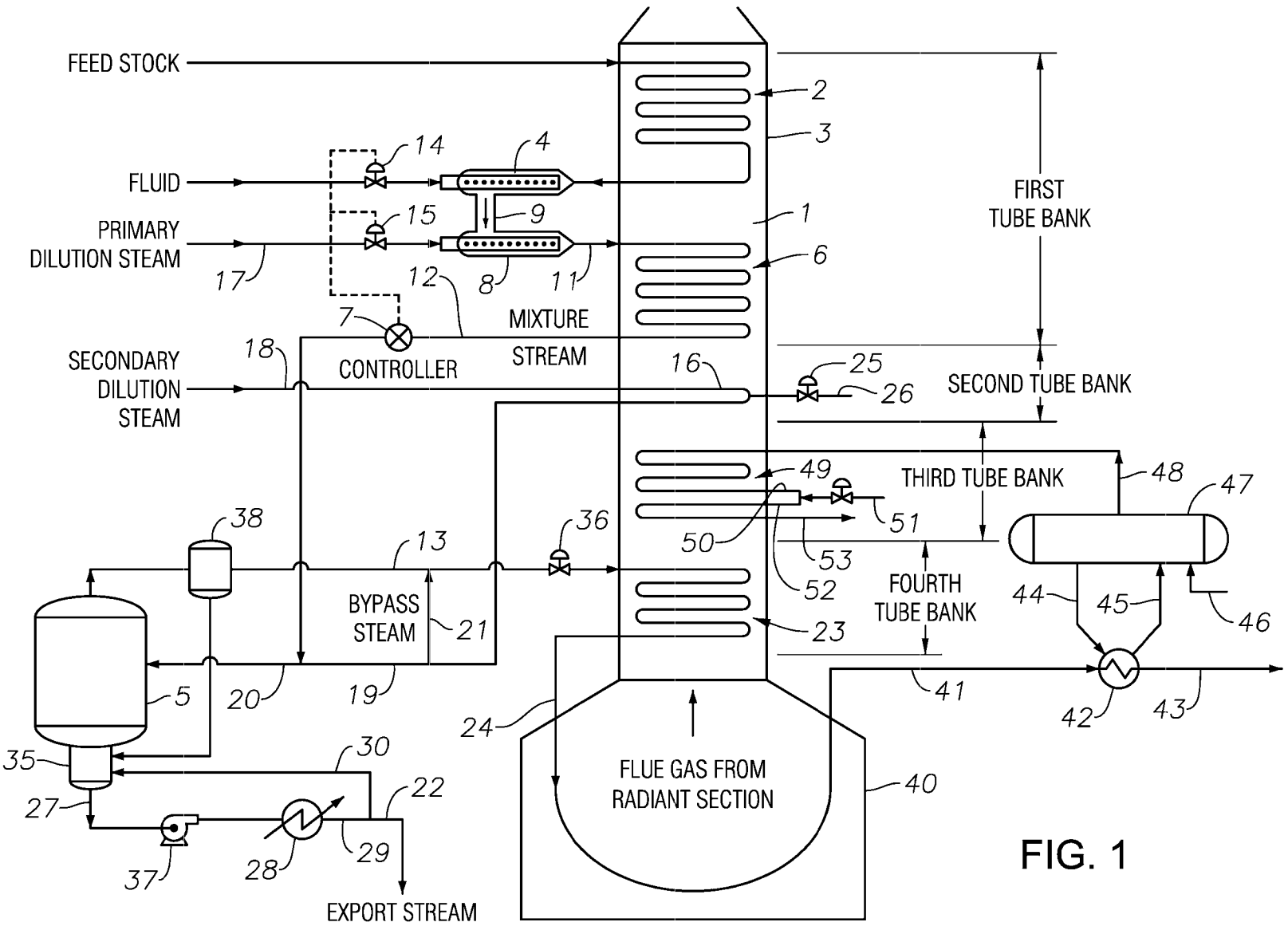
FIG. 1 schematically illustrates a hydrocarbon pyrolysis process.

In the present process, hydroprocessing of the pyrolysis tar is accomplished by combining at least a portion of the separated pyrolysis tar with a utility fluid comprising aromatic hydrocarbons and then contacting the combined pyrolysis tar and utility fluid with treatment gas comprising molecular hydrogen in the presence of a catalyst in at least one hydroprocessing zone.

In particular, it has been found that there is a beneficial decrease in reactor plugging when hydroprocessing pyrolysis tars having incompatibility number ($I_N$) >80, especially >100 or >110 if the utility fluid has a high solubility blending number ($S_{BN}$), for example, $S_{BN}$≥100, ≥120, or ≥140. While not wishing to be bound by any theory or model, it is believed the high incompatibility number $I_N$ molecules in some pyrolysis tars are incapable of being solubilized in utility fluid having lower $S_{BN}$. It has been observed that higher boiling point molecules in the hydroprocessed tar have higher solubility blending numbers ($S_{BN}$). By selecting higher boiling point molecules from the hydroprocessed tar, a utility fluid having higher $S_{BN}$ and decreased hydroprocessing reactor plugging may be achieved.

Generally, the utility fluid largely comprises a mixture of multi-ring compounds. The rings can be aromatic or non-aromatic and can contain a variety of substituents and/or heteroatoms. For example, the utility fluid can contain ≥40.0 wt %, ≥45.0 wt %, ≥50.0 wt %, ≥55.0 wt %, or ≥60.0 wt %, based on the weight of the utility fluid, of aromatic and non-aromatic ring compounds. Preferably, the utility fluid comprises aromatics. More preferably, the utility fluid comprises ≥25.0 wt %, ≥40.0 wt %, ≥50.0 wt %, ≥55.0 wt %, or ≥60.0 wt % aromatics, based on the weight of the utility fluid.

Typically, the utility fluid comprises one, two, and three ring aromatics. Preferably the utility fluid comprises ≥15 wt %, ≥20 wt %, ≥25.0 wt %, ≥40.0 wt %, ≥50.0 wt %, ≥55.0 wt %, or ≥60.0 wt % 2-ring and/or 3-ring aromatics, based on the weight of the utility fluid. The 2-ring and 3-ring aromatics are preferred due to their higher $S_{BN}$.

The utility fluid has an ASTM D86 10% distillation point ≥60° C. and a 90% distillation point ≤425° C., typically ≤400° C. In embodiments, the utility fluid has a true boiling point distribution with an initial boiling point ≥130° C. (266° F.) and a final boiling point ≤566° C. (1050° F.). In other embodiments, the utility fluid can have a true boiling point distribution with an initial boiling point ≥150° C. (300° F.) and a final boiling point ≤430° C. (806° F.). In still other embodiments, the utility fluid can have a true boiling point distribution with an initial boiling point ≥177° C. (350° F.) and a final boiling point ≤425° C. (797° F.). True boiling point distributions ("TBP", the distribution at atmospheric pressure) can be determined, e.g., by conventional methods such as the method of ASTM D7500. When the final boiling point is greater than that specified in the standard, the true boiling point distribution can be determined by extrapolation.

The relative amounts of utility fluid and tar stream employed during hydroprocessing are generally in the range of from about 20.0 wt % to about 95.0 wt % of the tar stream and from about 5.0 wt % to about 80.0 wt % of the utility fluid, based on total weight of utility fluid plus tar stream. For example, the relative amounts of utility fluid and tar stream during hydroprocessing can be in the range of (i) about 20.0 wt % to about 90.0 wt % of the tar stream and about 10.0 wt % to about 80.0 wt % of the utility fluid, or (ii) from about 40.0 wt % to about 90.0 wt % of the tar stream and from about 10.0 wt % to about 60.0 wt % of the utility fluid. In an embodiment, the utility fluid: tar weight ratio can be ≥0.01, e.g., in the range of 0.05 to 4.0, such as in the range of 0.1 to 3.0, or 0.3 to 1.1. At least a portion of the utility fluid can be combined with at least a portion of the tar stream within the hydroprocessing vessel or hydroprocessing zone, but this is not required, and in one or more embodiments at least a portion of the utility fluid and at least a portion of the tar stream are supplied as separate streams and combined into one feed stream prior to entering (e.g., upstream of) the hydroprocessing stage(s). For example, the tar stream and utility fluid can be combined to produce a feedstock upstream of the hydroprocessing stage, the feedstock comprising, e.g., (i) about 20.0 wt % to about 90.0 wt % of the tar stream and about 10.0 wt % to about 80.0 wt % of the utility fluid, or (ii) from about 40.0 wt % to about 90.0 wt % of the tar stream and from about 10.0 wt % to about 60.0 wt % of the utility fluid, the weight percents being based on the weight of the feedstock.

In some embodiments the combined pyrolysis tar and utility fluid has a $S_{BN}$≥110. Thus it has been found that there is a beneficial decrease in reactor plugging when hydroprocessing pyrolysis tars having incompatibility number ($I_N$) >80 if, after being combined, the utility fluid and tar mixture has a solubility blending number ($S_{BN}$) ≥110, ≥120, ≥130. Additionally, it has been found that there is a beneficial decrease in reactor plugging when hydroprocessing pyrolysis tars having incompatibility number ($I_N$) >110 if, after being combined, the utility fluid and tar mixture has a solubility blending number ($S_{BN}$) ≥150, ≥155, or ≥160.

Hydroprocessing of the tar stream in the presence of the utility fluid can occur in one or more hydroprocessing stages, the stages comprising one or more hydroprocessing vessels or zones. Vessels and/or zones within the hydroprocessing stage in which catalytic hydroprocessing activity occurs generally include at least one hydroprocessing catalyst. The catalysts can be mixed or stacked, such as when the catalyst is in the form of one or more fixed beds in a vessel or hydroprocessing zone.

Conventional hydroprocessing catalysts can be utilized for hydroprocessing the tar stream in the presence of the utility fluid, such as those specified for use in resid and/or heavy oil hydroprocessing, but the invention is not limited thereto. Suitable hydroprocessing catalysts include those comprising (i) one or more bulk metals and/or (ii) one or more metals on a support. The metals can be in elemental form or in the form of a compound. In one or more embodiments, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof.

In one or more embodiments, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In a particular embodiment, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

In an embodiment, the catalyst comprises at least one Group 6 metal. Examples of preferred Group 6 metals include chromium, molybdenum and tungsten. The catalyst may contain, per gram of catalyst, a total amount of Group 6 metals of at least 0.00001 grams, or at least 0.01 grams, or at least 0.02 grams, in which grams are calculated on an elemental basis. For example the catalyst can contain a total amount of Group 6 metals per gram of catalyst in the range of from 0.0001 grams to 0.6 grams, or from 0.001 grams to 0.3 grams, or from 0.005 grams to 0.1 grams, or from 0.01 grams to 0.08 grams, the number of grams being calculated on an elemental basis.

In related embodiments, the catalyst includes at least one Group 6 metal and further includes at least one metal from Group 5, Group 7, Group 8, Group 9, or Group 10. Such catalysts can contain, e.g., the combination of metals at a molar ratio of Group 6 metal to Group 5 metal in a range of from 0.1 to 20, 1 to 10, or 2 to 5, in which the ratio is on an elemental basis. Alternatively, the catalyst can contain the combination of metals at a molar ratio of Group 6 metal to a total amount of Groups 7 to 10 metals in a range of from 0.1 to 20, 1 to 10, or 2 to 5, in which the ratio is on an elemental basis.

When the catalyst includes at least one Group 6 metal and one or more metals from Groups 9 or 10, e.g., molybdenum-cobalt and/or tungsten-nickel, these metals can be present, e.g., at a molar ratio of Group 6 metal to Groups 9 and 10 metals in a range of from 1 to 10, or from 2 to 5, in which the ratio is on an elemental basis. When the catalyst includes at least one of Group 5 metal and at least one Group 10 metal, these metals can be present, e.g., at a molar ratio of Group 5 metal to Group 10 metal in a range of from 1 to 10, or from 2 to 5, where the ratio is on an elemental basis. Catalysts which further comprise inorganic oxides, e.g., as a binder and/or support, are within the scope of the invention. For example, the catalyst can comprise (i) ≥1.0 wt % of one or more metals selected from Groups 6, 8, 9, and 10 of the Periodic Table, and (ii) ≥1.0 wt % of an inorganic oxide, the weight percents being based on the weight of the catalyst.

In one or more embodiments, the catalyst is a bulk multimetallic hydroprocessing catalyst with or without binder. In an embodiment the catalyst is a bulk trimetallic catalyst comprised of two Group 8 metals, preferably Ni and Co and one Group 6 metal, preferably Mo.

The invention encompasses incorporating into (or depositing on) a support one or catalytic metals e.g., one or more metals of Groups 5 to 10 and/or Group 15, to form the hydroprocessing catalyst. The support can be a porous material. For example, the support can comprise one or more refractory oxides, porous carbon-based materials, zeolites, or combinations thereof suitable refractory oxides include, e.g., alumina, silica, silica-alumina, titanium oxide, zirconium oxide, magnesium oxide, and mixtures thereof. Suitable porous carbon-based materials include activated carbon and/or porous graphite. Examples of zeolites include, e.g., Y-zeolites, beta zeolites, mordenite zeolites, ZSM-5 zeolites, and ferrierite zeolites. Additional examples of support materials include gamma alumina, theta alumina, delta alumina, alpha alumina, or combinations thereof. The amount of gamma alumina, delta alumina, alpha alumina, or combinations thereof, per gram of catalyst support, can be in a range of from 0.0001 grams to 0.99 grams, or from 0.001 grams to 0.5 grams, or from 0.01 grams to 0.1 grams, or at most 0.1 grams, as determined by x-ray diffraction. In a particular embodiment, the hydroprocessing catalyst is a supported catalyst, and the support comprises at least one alumina, e.g., theta alumina, in an amount in the range of from 0.1 grams to 0.99 grams, or from 0.5 grams to 0.9 grams, or from 0.6 grams to 0.8 grams, the amounts being per gram of the support. The amount of alumina can be determined using, e.g., x-ray diffraction. In alternative embodiments, the support can comprise at least 0.1 grams, or at least 0.3 grams, or at least 0.5 grams, or at least 0.8 grams of theta alumina.

When a support is utilized, the support can be impregnated with the desired metals to form the hydroprocessing catalyst. The support can be heat-treated at temperatures in a range of from 400° C. to 1200° C., or from 450° C. to 1000° C., or from 600° C. to 900° C., prior to impregnation with the metals. In certain embodiments, the hydroprocessing catalyst can be formed by adding or incorporating the Groups 5 to 10 metals to shaped heat-treated mixtures of support. This type of formation is generally referred to as overlaying the metals on top of the support material. Optionally, the catalyst is heat treated after combining the support with one or more of the catalytic metals, e.g., at a temperature in the range of from 150° C. to 750° C., or from 200° C. to 740° C., or from 400° C. to 730° C. Optionally, the catalyst is heat treated in the presence of hot air and/or oxygen-rich air at a temperature in a range between 400° C. and 1000° C. to remove volatile matter such that at least a portion of the Groups 5 to 10 metals are converted to their corresponding metal oxide. In other embodiments, the catalyst can be heat treated in the presence of oxygen (e.g., air) at temperatures in a range of from 35° C. to 500° C., or from 100° C. to 400° C., or from 150° C. to 300° C. Heat treatment can take place for a period of time in a range of from 1 to 3 hours to remove a majority of volatile components without converting the Groups 5 to 10 metals to their metal oxide form. Catalysts prepared by such a method are generally referred to as "uncalcined" catalysts or "dried." Such catalysts can be prepared in combination with a sulfiding method, with the Groups 5 to 10 metals being substantially dispersed in the support. When the catalyst comprises a theta alumina support and one or more Groups 5 to 10 metals, the catalyst is generally heat treated at a temperature ≥400° C. to form the hydroprocessing catalyst. Typically, such heat treating is conducted at temperatures ≤1200° C.

The catalyst can be in shaped forms, e.g., one or more of discs, pellets, extrudates, etc., though this is not required. Non-limiting examples of such shaped forms include those having a cylindrical symmetry with a diameter in the range of from about 0.79 mm to about 3.2 mm ($1/32^{nd}$ to $1/8^{th}$ inch), from about 1.3 mm to about 2.5 mm ($1/20^{th}$ to $1/10^{th}$ inch), or from about 1.3 mm to about 1.6 mm ($1/20^{th}$ to $1/16^{th}$ inch). Similarly-sized non-cylindrical shapes are within the scope of the invention, e.g., trilobe, quadralobe, etc. Optionally, the catalyst has a flat plate crush strength in a range of from 50-500 N/cm, or 60-400 N/cm, or 100-350 N/cm, or 200-300 N/cm, or 220-280 N/cm.

Porous catalysts, including those having conventional pore characteristics, are within the scope of the invention. When a porous catalyst is utilized, the catalyst can have a pore structure, pore size, pore volume, pore shape, pore surface area, etc., in ranges that are characteristic of conventional hydroprocessing catalysts, though the invention is not limited thereto. For example, the catalyst can have a median pore size that is effective for hydroprocessing SCT molecules, such catalysts having a median pore size in the range of from 30 Å to 1000 Å, or 50 Å to 500 Å, or 60 Å to 300 Å. Pore size can be determined according to ASTM Method D4284-07 Mercury Porosimetry.

In a particular embodiment, the hydroprocessing catalyst has a median pore diameter in a range of from 50 Å to 200 Å. Alternatively, the hydroprocessing catalyst has a median pore diameter in a range of from 90 Å to 180 Å, or 100 Å to 140 Å, or 110 Å to 130 Å. In another embodiment, the hydroprocessing catalyst has a median pore diameter ranging from 50 Å to 150 Å. Alternatively, the hydroprocessing catalyst has a median pore diameter in a range of from 60 Å to 135 Å, or from 70 Å to 120 Å. In yet another alternative, hydroprocessing catalysts having a larger median pore diameter are utilized, e.g., those having a median pore diameter in a range of from 180 Å to 500 Å, or 200 Å to 300 Å, or 230 Å to 250 Å.

Generally, the hydroprocessing catalyst has a pore size distribution that is not so great as to significantly degrade catalyst activity or selectivity. For example, the hydroprocessing catalyst can have a pore size distribution in which at least 60% of the pores have a pore diameter within 45 Å, 35 Å, or 25 Å of the median pore diameter. In certain embodiments, the catalyst has a median pore diameter in a range of from 50 Å to 180 Å, or from 60 Å to 150 Å, with at least 60% of the pores having a pore diameter within 45 Å, 35 Å, or 25 Å of the median pore diameter.

When a porous catalyst is utilized, the catalyst can have, e.g., a pore volume ≥0.3 $cm^3/g$, such ≥0.7 $cm^3/g$, or ≥0.9 $cm^3/g$. In certain embodiments, pore volume can range, e.g., from 0.3 $cm^3/g$ to 0.99 $cm^3/g$, 0.4 $cm^3/g$ to 0.8 $cm^3/g$, or 0.5 $cm^3/g$ to 0.7 $cm^3/g$.

In certain embodiments, a relatively large surface area can be desirable. As an example, the hydroprocessing catalyst can have a surface area ≥60 $m^2/g$, or ≥100 $m^2/g$, or ≥120 $m^2/g$, or ≥170 $m^2/g$, or ≥220 $m^2/g$, or ≥270 $m^2/g$; such as in the range of from 100 $m^2/g$ to 300 $m^2/g$, or 120 $m^2/g$ to 270 $m^2/g$, or 130 $m^2/g$ to 250 $m^2/g$, or 170 $m^2/g$ to 220 $m^2/g$.

Conventional hydrotreating catalysts can be used, but the invention is not limited thereto. In certain embodiments, the catalysts include one or more of KF860 available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; and FCC pretreat catalyst, such as DN3651 and/or DN3551, available from the same source. However, the invention is not limited to only these catalysts.

Hydroprocessing the specified amounts of tar stream and utility fluid using the specified hydroprocessing catalyst and specified utility fluid leads to improved catalyst life, e.g., allowing the hydroprocessing stage to operate for at least 3 months, or at least 6 months, or at least 1 year without replacement of the catalyst in the hydroprocessing or contacting zone. Catalyst life is generally >10 times longer than would be the case if no utility fluid were utilized, e.g., ≥100 times longer, such as ≥1000 times longer.

The hydroprocessing is carried out in the presence of hydrogen, e.g., by (i) combining molecular hydrogen with the tar stream and/or utility fluid upstream of the hydroprocessing, and/or (ii) conducting molecular hydrogen to the hydroprocessing stage in one or more conduits or lines. Although relatively pure molecular hydrogen can be utilized for the hydroprocessing, it is generally desirable to utilize a "treat gas" which contains sufficient molecular hydrogen for the hydroprocessing and optionally other species (e.g., nitrogen and light hydrocarbons such as methane) which generally do not adversely interfere with or affect either the reactions or the products. Unused treat gas can be separated from the hydroprocessed effluent for re-use, generally after removing undesirable impurities, such as $H_2S$ and $NH_3$. The treat gas optionally contains ≥ about 50 vol. % of molecular hydrogen, e.g., ≥ about 75 vol. %, based on the total volume of treat gas conducted to the hydroprocessing stage.

Optionally, the amount of molecular hydrogen supplied to the hydroprocessing stage is in the range of from about 1000 SCF/B (standard cubic feet per barrel) (178 S $m^3/m^3$) to 10000 SCF/B (1780 S $m^3/m^3$), in which B refers to barrel of feed to the hydroprocessing stage (e.g., tar stream plus utility fluid). For example, the molecular hydrogen can be provided in a range of from 3000 SCF/B (534 S $m^3/m^3$) to 6000 SCF/B (1068 S $m^3/m^3$). Hydroprocessing the tar stream in the presence of the specified utility fluid, molecular hydrogen, and a catalytically effective amount of the specified hydroprocessing catalyst under catalytic hydroprocessing conditions produces an upgraded (hydroprocessed) tar product including, e.g., upgraded SCT. Preferably, the amount of molecular hydrogen required to hydroprocess the specified tar stream is less than if the tar stream contained higher amounts of $C_{6+}$ olefin, for example, vinyl aromatics. Optionally, higher amounts of molecular hydrogen may be supplied, for example, when the tar stream contains relatively higher amounts of sulfur.

The hydroprocessing is carried out under hydroprocessing conditions, e.g., under conditions for carrying out one or more of hydrocracking (including selective hydrocracking), hydrogenation, hydrotreating, hydrodesulfurization, hydrodenitrogenation, hydrodemetallation, hydrodearomatization, hydroisomerization, or hydrodewaxing of the specified tar stream. The hydroprocessing reaction can be carried out in at least one vessel or zone that is located, e.g., within a hydroprocessing stage downstream of the pyrolysis stage and separation stage. The specified tar stream generally contacts the hydroprocessing catalyst in the vessel or zone, in the presence of the utility fluid and molecular hydrogen. Catalytic hydroprocessing conditions can include, e.g., exposing the combined diluent-tar stream to a temperature in the range from 200° C. to 500° C. or from 250° C. to 450° C. or from 300° C. to 430° C. or from 350° C. to 420° C. proximate to the molecular hydrogen and hydroprocessing catalyst. For example, a temperature in the range of from 300° C. to 500° C., or 350° C. to 430° C., or 360° C. to 420° C. can be utilized. Molecular hydrogen partial pressure during the hydroprocessing is generally >8 MPa, such as at least 9 MPa, for example at least 10 MPa and in some embodiments is ≤14 MPa, such as ≤13 MPa, for example ≤12 MPa. Weight hourly space velocity (WHSV) of the combined diluent-tar stream is generally >0.3 $hr^{-1}$, such as >0.5 $hr^{-1}$, for example >1.0 $hr^{-1}$ and in some embodiments is ≤5 $hr^{-1}$, such as ≤4 $hr^{-1}$, for example ≤3 $hr^{-1}$. In particular, the hydroprocessing conditions are controlled such that the molecular hydrogen consumption rate is in the range of about 270 standard cubic meters/cubic meter (S $m^3/m^3$) to about 445 S $m^3/m^3$ (1600 SCF/B to 2400 SCF/B, where the denominator represents barrels of the tar stream, e.g., barrels of SCT), for example in the range of about 280 to about 430 S $m^3/m^3$, such as in the range of about 290 to about 420 S $m^3/m^3$, for example in the range of about 300 to about 410 S $m^3/m^3$.

Figure 2:
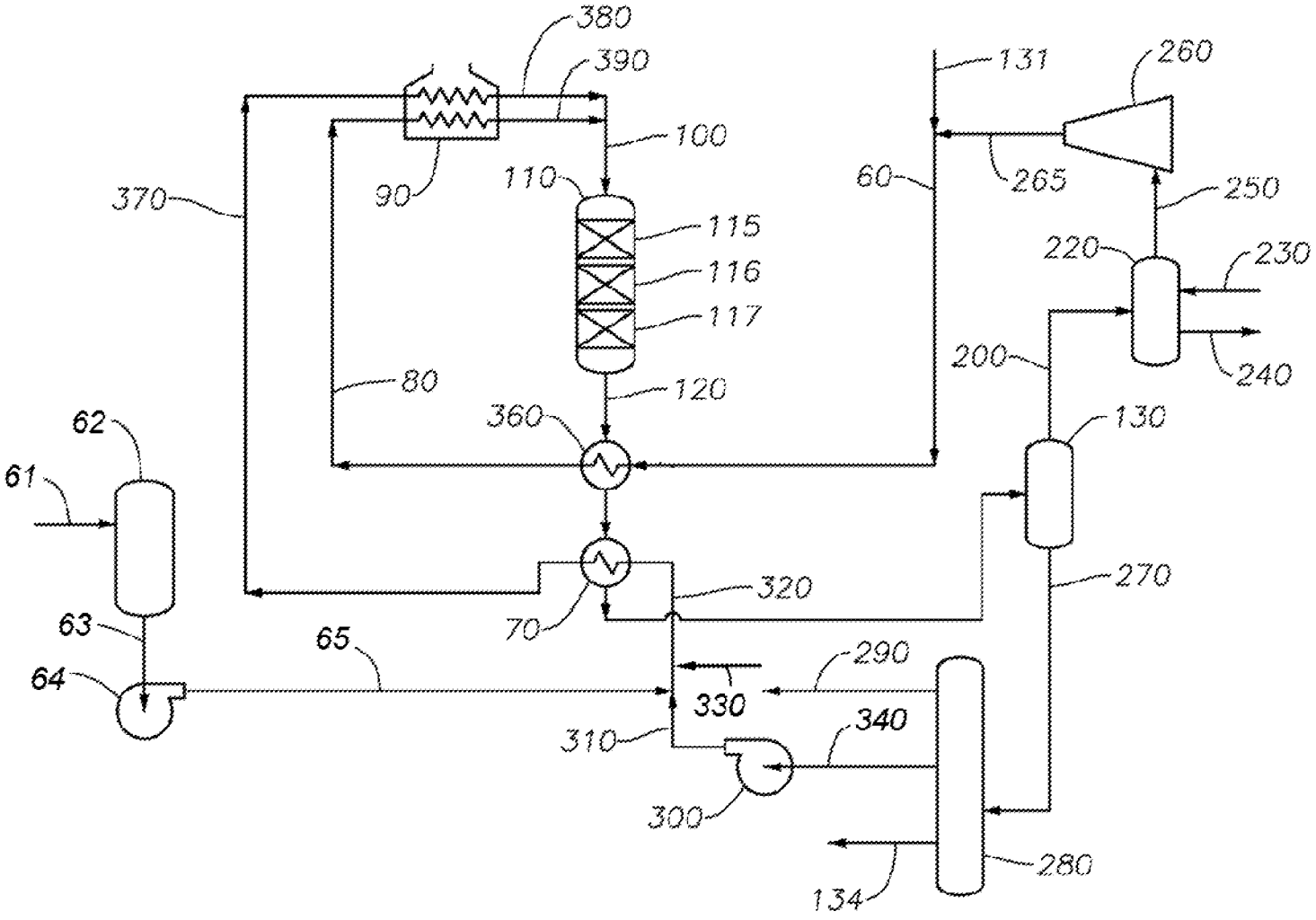
FIG. 2 schematically illustrates a pyrolysis tar hydroprocessing process.

One embodiment of a suitable hydroprocessing process is disclosed in FIG. 2, in which a pyrolysis tar stream is introduced via conduit 61 to separation stage 62 for separation of one or more light gases and/or particulates from the tar stream. The remaining tar stream is collected in conduit 63 and transferred by pump 64 through conduit 65 for mixing with a utility fluid supplied via line 310. The tar-fluid mixture is then conducted to a first pre-heater 70 via conduit 320. Optionally, a supplemental utility fluid, may be added via conduit 330. The combined stream, a tar-fluid mixture which is primarily in liquid phase, is conducted to a supplemental pre-heat stage 90 via conduit 370. The supplemental pre-heat stage 90 can be, e.g., a fired heater. Recycled treat gas, comprising molecular hydrogen, is obtained from conduit 265 and, if necessary, is mixed with fresh treat gas, supplied through conduit 131. The treat gas is conducted via conduit 60 to a second pre-heater 360, before being conducted to the supplemental pre-heat stage 90 via conduit 80.

The pre-heated tar-fluid mixture (from line 380) is combined with the pre-heated treat gas (from line 390) and then conducted via line 100 to a hydroprocessing reactor 110. Mixing means are utilized for combining the pre-heated tar-fluid mixture with the pre-heated treat gas in hydroprocessing reactor 110, e.g., one or more gas-liquid distributors of the type conventionally utilized in fixed bed reactors. The tar is hydroprocessed in the presence of the utility fluid, supplemental utility fluid, the treat gas, and hydroprocessing catalyst in at least one catalyst bed 115. Additional catalyst beds, e.g., 116, 117, etc., may be connected in series with the catalyst bed 115 with optional intercooling quench using treat gas from conduit 60 being provided between beds (not shown).

The hydroprocessed effluent is conducted away from hydroprocessing reactor 110 via conduit 120. When the first and second preheaters 70, 360 are heat exchangers, the hot hydroprocessing effluent in conduit 120 can be used to preheat the tar/utility fluid and the treat gas respectively by indirect heat transfer. Following this optional heat exchange, the hydroprocessed effluent is conducted to separation stage 130 for separating total vapor product (e.g., heteroatom vapor, vapor-phase cracked products, unused treat gas, etc.) and total liquid product ("TLP") from the hydroprocessed effluent. The total vapor product is conducted via line 200 to upgrading stage 220, which comprises, e.g., one or more amine towers. Fresh amine is conducted to stage 220 via line 230, with rich amine conducted away via line 240. Unused treat gas is conducted away from stage 220 via line 250, compressed in compressor 260, and conducted via lines 265, 60, and 80 for re-cycle and re-use in the hydroprocessing stage 110.

All or a portion of the TLP from separation stage 130 can be an upgraded tar product (not shown), useful as a diluent (e.g., a flux) for heavy hydrocarbons, especially those of relatively high viscosity. Optionally, all or a portion of the TLP can substitute for more expensive, conventional diluents. Non-limiting examples of heavy, high-viscosity streams suitable for blending with the bottoms include one or more of bunker fuel, burner oil, heavy fuel oil (e.g., No. 5 or No. 6 fuel oil), high-sulfur fuel oil, low-sulfur fuel oil, regular-sulfur fuel oil (RSFO), and the like.

The TLP from separation stage 130 is conducted via line 270 to a further separation stage 280. Separation stage 280 may be, for example, a distillation column with side-stream draw although other conventional separation methods may be utilized. The TLP is separated in further separation stage 280 into an overhead stream, a side stream and a bottoms stream, listed in order of increasing boiling point. The overhead stream is conducted away from separation stage 280 via line 290. The bottoms stream is conducted away via line 134. The overhead and bottoms streams may be carried away for further processing. If desired, at least a portion of the bottoms can be utilized within the process and/or conducted away for storage or further processing. The bottoms portion of the TLP can be desirable as a diluent (e.g., a flux) for heavy hydrocarbons as described above. In certain embodiments, the overhead stream 290 and bottoms stream 134 of separation stage 280 are combined to form an upgraded tar product (not shown).

In certain aspects, the density of the upgraded tar product measured at 15° C. is at least 0.10 g/cm$^3$ less than the density of the raw pyrolysis tar (before hydroprocessing, ie. conduit 61 in FIG. 2). For example, the upgraded tar product density can be at least 0.12, preferably, at least 0.14, 0.15, or 0.17 g/cm3 less than the density of the raw pyrolysis tar.

In certain aspects the viscosity of the upgraded tar product measured at 50° C. is <200 cSt. For example, the upgraded tar product density can be <150 cSt, preferably, <100, <75, <50, <40 or <30 cSt.

In certain aspects the viscosity of the raw pyrolysis tar measured at 50° C. that is $\geq 1.0\times10^4$, e.g., $\geq 1.0\times10^5$, $\geq 1.0\times10^6$, or $\geq 1.0\times10^7$ cSt and the viscosity of the upgraded pyrolysis tar product measured at 50° C. is <200 cSt, e.g., <150 cSt, preferably, <100, <75, <50, <40, or <30 cSt.

Optionally, trim molecules may be separated, for example, in a fractionator (not shown), from separation stage 280 bottoms or overhead or both and added to the side stream 340 as desired. The side stream is carried away from separation stage 280 via conduit 340. At least a portion of the side stream 340 is utilized as utility fluid and conducted via pump 300 and conduit 310. The utility fluid comprises ≥10 wt. % of the side stream, based on the weight of the utility fluid.

Preferably, the operation of separation stage 280 is adjusted to shift the boiling point distribution of side stream 340 so that side stream 340 has properties desired for the utility fluid. Side stream 340 can have a true boiling point distribution having an initial boiling point ≥177° C. (350° F.) and a final boiling point ≤566° C. (1050° F.). The side stream can also have a true boiling point distribution having an initial boiling point ≥177° C. (350° F.) and a final boiling point ≤430° C. (800° F.). The side stream can have $S_{BN}\geq100$, ≥120, ≥125, or ≥130.

Pyrolysis Tar

Aspects of the invention relate to hydroprocessing a pyrolysis tar in the presence of a utility fluid. Pyrolysis tar can be produced by exposing a hydrocarbon-containing feed to pyrolysis conditions in order to produce a pyrolysis effluent, the pyrolysis effluent being a mixture comprising unreacted feed, unsaturated hydrocarbon produced from the feed during the pyrolysis, and pyrolysis tar. For example, when a feed comprising ≥10.0 wt. % hydrocarbon, based on the weight of the feed, is subjected to pyrolysis, the pyrolysis effluent generally contains pyrolysis tar and ≥1.0 wt. % of $C_2$ unsaturates, based on the weight of the pyrolysis effluent. The pyrolysis tar typically comprises ≥90 wt. %, of the pyrolysis effluent's molecules having an atmospheric boiling point of ≥290° C. Besides hydrocarbon, the feed to pyrolysis optionally further comprise diluent, e.g., one or more of nitrogen, water, etc. For example, the feed may further comprise ≥1.0 wt. % diluent based on the weight of the feed, such as ≥25.0 wt. %. When the diluent includes an appreciable amount of steam, the pyrolysis is referred to as steam cracking. For the purpose of this description and appended claims, the following terms are defined.

The term "pyrolysis tar" means (a) a mixture of hydrocarbons having one or more aromatic components and optionally (b) non-aromatic and/or non-hydrocarbon molecules, the mixture being derived from hydrocarbon pyrolysis, with at least 70% of the mixture having a boiling point at atmospheric pressure that is ≥ about 550° F. (290° C.). Certain pyrolysis tars have an initial boiling point ≥200° C. For certain pyrolysis tars, ≥90.0 wt. % of the pyrolysis tar has a boiling point at atmospheric pressure ≥550° F. (290° C.). Pyrolysis tar can comprise, e.g., ≥50.0 wt. %, e.g., ≥75.0 wt. %, such as ≥90.0 wt. %, based on the weight of the pyrolysis tar, of hydrocarbon molecules (including mixtures and aggregates thereof) having (i) one or more aromatic components and (ii) a number of carbon atoms ≥ about 15. Pyrolysis tar generally has a metals content, $\leq 1.0\times10^3$ ppmw, based on the weight of the pyrolysis tar, which is an amount of metals that is far less than that found in crude oil (or crude oil components) of the same average viscosity. "SCT" means pyrolysis tar obtained from steam cracking.

"Tar Heavies" (TH) means a product of hydrocarbon pyrolysis, the TH having an atmospheric boiling point ≥565° C. and comprising ≥5.0 wt. % of molecules having a plurality of aromatic cores based on the weight of the product. The TH are typically solid at 25.0° C. and generally include the fraction of SCT that is not soluble in a 5:1 (vol.:vol.) ratio of n-pentane: SCT at 25.0° C. TH generally include asphaltenes and other high molecular weight molecules.

Aspects of the invention which include producing SCT by steam cracking will now be described in more detail. The invention is not limited to these aspects, and this description is not meant to foreclose other aspects within the broader scope of the invention, such as those which do not include steam cracking.

Production of Pyrolysis Tar by Steam Cracking

Conventional steam cracking utilizes a pyrolysis furnace which has two main sections: a convection section and a radiant section. The pyrolysis feedstock typically enters the convection section of the furnace where the hydrocarbon component of the pyrolysis feedstock is heated and vaporized by indirect contact with hot flue gas from the radiant section and by direct contact with the steam component of the pyrolysis feedstock. The vaporized hydrocarbon component is then introduced into the radiant section where ≥50% (weight basis) of the cracking takes place. A pyrolysis effluent is conducted away from the pyrolysis furnace, the pyrolysis effluent comprising products resulting from the pyrolysis of the pyrolysis feedstock and any unconverted components of the pyrolysis feedstock. At least one separation stage is generally located downstream of the pyrolysis furnace, the separation stage being utilized for separating from the pyrolysis effluent one or more of light olefin, SCN, SCGO, SCT, water, unreacted hydrocarbon components of the pyrolysis feedstock, etc. The separation stage can comprise, e.g., a primary fractionator. Generally, a cooling stage is located between the pyrolysis furnace and the separation stage. Conventional cooling means can be utilized by the cooling stage, e.g., one or more of direct quench and/or indirect heat exchange, but the invention is not limited thereto.

In certain aspects, the pyrolysis tar is SCT produced in one or more steam cracking furnaces. Besides SCT, such furnaces generally produce (i) vapor-phase products such as one or more of acetylene, ethylene, propylene, butenes, and (ii) liquid-phase products comprising, e.g., one or more of $C_{5+}$ molecules, and mixtures thereof. The liquid-phase products are generally conducted together to a separation stage, e.g., a primary fractionator, for separation of one or more of (a) overheads comprising steam-cracked naphtha ("SCN", e.g., $C_5$-$C_{10}$ species) and steam cracked gas oil ("SCGO"), the SCGO comprising ≥90.0 wt. % based on the weight of the SCGO of molecules (e.g., $C_{10}$-$C_{17}$ species) having an atmospheric boiling point in the range of about 400° F. to 550° F. (200° C. to 290° C.), and (b) a bottoms stream comprising ≥90.0 wt. % SCT, based on the weight of the bottoms stream. The SCT can have, e.g., a boiling range ≥ about 550° F. (290° C.) and can comprise molecules and mixtures thereof having a number of carbon atoms ≥ about 15.

The pyrolysis feedstock typically comprises hydrocarbon and steam. In certain aspects, the pyrolysis feedstock comprises ≥10.0 wt. % hydrocarbon, based on the weight of the pyrolysis feedstock, e.g., ≥25.0 wt. %, ≥50.0 wt. %, such as ≥65 wt. %. Although the pyrolysis feedstock's hydrocarbon can comprise one or more light hydrocarbons such as methane, ethane, propane, butane etc., it can be particularly advantageous to utilize a pyrolysis feedstock comprising a significant amount of higher molecular weight hydrocarbons because the pyrolysis of these molecules generally results in more SCT than does the pyrolysis of lower molecular weight hydrocarbons. As an example, the pyrolysis feedstock can comprise ≥1.0 wt. % or ≥25.0 wt. % based on the weight of the pyrolysis feedstock of hydrocarbons that are in the liquid phase at ambient temperature and atmospheric pressure. More than one steam cracking furnace can be used, and these can be operated (i) in parallel, where a portion of the pyrolysis feedstock is transferred to each of a plurality of furnaces, (ii) in series, where at least a second furnace is located downstream of a first furnace, the second furnace being utilized for cracking unreacted pyrolysis feedstock components in the first furnace's pyrolysis effluent, and (iii) a combination of (i) and (ii).

In certain embodiments, the hydrocarbon component of the pyrolysis feedstock comprises ≥5 wt. % of non-volatile components, e.g., ≥30 wt. %, such as ≥40 wt. %, or in the range of 5 wt. % to 50 wt. %, based on the weight of the hydrocarbon component. Non-volatile components are the fraction of the hydrocarbon feed with a nominal boiling point above 1100° F. (590° C.) as measured by ASTM D-6352-98, D-7580. These ASTM methods can be extrapolated, e.g., when a hydrocarbon has a final boiling point that is greater than that specified in the standard. The hydrocarbon's non-volatile components can include coke precursors, which are moderately heavy and/or reactive molecules, such as multi-ring aromatic compounds, which can condense from the vapor phase and then form coke under the operating conditions encountered in the present process of the invention. Examples of suitable hydrocarbons include, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$/residue admixture, naphtha/residue admixture, gas oil/residue admixture, and crude oil. The hydrocarbon component of the pyrolysis feedstock can have a nominal final boiling point of at least about 600° F. (315° C.), generally greater than about 950° F. (510° C.), typically greater than about 1100° F. (590° C.), for example greater than about 1400° F. (760° C.). Nominal final boiling point means the temperature at which 99.5 weight percent of a particular sample has reached its boiling point.

In certain aspects, the hydrocarbon component of the pyrolysis feedstock comprises ≥10.0 wt. %, e.g., ≥50.0 wt. %, such as ≥90.0 wt. % (based on the weight of the hydrocarbon) of one or more of naphtha, gas oil, vacuum gas oil, waxy residues, atmospheric residues, residue admixtures, or crude oil; including those comprising ≥ about 0.1 wt. % asphaltenes. When the hydrocarbon includes crude oil and/or one or more fractions thereof, the crude oil is optionally desalted prior to being included in the pyrolysis feedstock. An example of a crude oil fraction utilized in the pyrolysis feedstock is produced by separating atmospheric pipestill ("APS") bottoms from a crude oil followed by vacuum pipestill ("VPS") treatment of the APS bottoms.

Suitable crude oils include, e.g., high-sulfur virgin crude oils, such as those rich in polycyclic aromatics. For example, the pyrolysis feedstock's hydrocarbon can include ≥90.0 wt. % of one or more crude oils and/or one or more crude oil fractions, such as those obtained from an atmospheric APS and/or VPS; waxy residues; atmospheric residues; naphthas contaminated with crude; various residue admixtures; and SCT.

Optionally, the hydrocarbon component of the pyrolysis feedstock comprises sulfur, e.g., ≥0.1 wt. % sulfur, e.g., ≥1.0 wt. %, such as in the range of about 1.0 wt. % to about 5.0 wt. %, based on the weight of the hydrocarbon component of the pyrolysis feedstock. Optionally, at least a portion of the pyrolysis feedstock's sulfur-containing molecules, e.g., ≥10.0 wt. % of the pyrolysis feedstock's sulfur-containing molecules, contain at least one aromatic ring ("aromatic sulfur"). When (i) the pyrolysis feedstock's hydrocarbon is a crude oil or crude oil fraction comprising ≥0.1 wt. % of aromatic sulfur and (ii) the pyrolysis is steam cracking, then the SCT contains a significant amount of sulfur derived from the pyrolysis feedstock's aromatic sulfur. For example, the SCT sulfur content can be about 3 to 4 times higher in the SCT than in the pyrolysis feedstock's hydrocarbon component, on a weight basis.

It has been found that including sulfur and/or sulfur-containing molecules in the pyrolysis feedstock lessens the amount of olefinic unsaturation (and the total amount of olefin) present in the SCT. For example, when the hydrocarbon component of the pyrolysis feedstock comprises sulfur, e.g., ≥0.1 wt. % sulfur, e.g., ≥1.0 wt. %, such as in the range of about 1.0 wt. % to about 5.0 wt. %, based on the weight of the hydrocarbon component of the pyrolysis feedstock, then the amount of olefin contained in the SCT is ≤10.0 wt. %, e.g., ≤5.0 wt. %, such as ≤2.0 wt. %, based on the weight of the SCT. More particularly, the amount of (i) vinyl aromatics in the SCT and/or (ii) aggregates in the SCT which incorporate vinyl aromatics is ≤5.0 wt. %, e.g., ≤3 wt. %, such as ≤2.0 wt. %. While not wishing to be bound by any theory or model, it is believed that the amount of olefin in the SCT is lessened because the presence of feed sulfur leads to an increase in amount of sulfur-containing hydrocarbon molecules in the pyrolysis effluent. Such sulfur-containing molecules can include, for example, one or more of mercaptans; thiophenols; thioethers, such as heterocyclic thioethers (e.g., dibenzosulfide; thiophenes, such as benzothiophene and dibenzothiophene; etc.) The formation of these sulfur-containing hydrocarbon molecules is believed to lessen the amount of amount of relatively high molecular weight olefinic molecules (e.g., $C_{6+}$ olefin) produced during and after the pyrolysis, which results in fewer vinyl aromatic molecules available for inclusion in SCT, e.g., among the SCT's TH aggregates. In other words, when the pyrolysis feedstock includes sulfur, the pyrolysis favors the formation in the SCT of sulfur-containing hydrocarbon, such as $C_{6+}$ mercaptan, over $C_{6+}$ olefins such as vinyl aromatics.

In certain embodiments, the pyrolysis feedstock comprises steam in an amount in the range of from 10.0 wt. % to 90.0 wt. %, based on the weight of the pyrolysis feedstock, with the remainder of the pyrolysis feedstock comprising (or consisting essentially of, or consisting of) the hydrocarbon. Such a pyrolysis feedstock can be produced by combining hydrocarbon with steam, e.g., at a ratio of 0.1 to 1.0 kg steam per kg hydrocarbon, or a ratio of 0.2 to 0.6 kg steam per kg hydrocarbon.

When the pyrolysis feedstock's diluent comprises steam, the pyrolysis can be carried out under conventional steam cracking conditions. Suitable steam cracking conditions include, e.g., exposing the pyrolysis feedstock to a temperature (measured at the radiant outlet) ≥400° C., e.g., in the range of 400° C. to 900° C., and a pressure ≥0.1 bar, for a cracking residence time period in the range of from about 0.01 second to 5.0 second. In certain aspects, the pyrolysis feedstock comprises hydrocarbon and diluent, wherein:

a. the pyrolysis feedstock's hydrocarbon comprises ≥50.0 wt. % based on the weight of the pyrolysis feedstock's hydrocarbon of one or more of one or more crude oils and/or one or more crude oil fractions, such as those obtained from an APS and/or VPS; waxy residues; atmospheric residues; naphthas contaminated with crude; various residue admixtures; and SCT; and
b. the pyrolysis feedstock's diluent comprises, e.g., ≥95.0 wt. % water based on the weight of the diluent, wherein the amount of diluent in the pyrolysis feedstock is in the range of from about 10.0 wt. % to 90.0 wt. %, based on the weight of the pyrolysis feedstock.

In these aspects, the steam cracking conditions generally include one or more of (i) a temperature in the range of 760° C. to 880° C., (ii) a pressure in the range of from 1.0 to 5.0 bar (absolute), or (iii) a cracking residence time in the range of from 0.10 to 2.0 seconds.

A pyrolysis effluent is conducted away from the pyrolysis furnace, the pyrolysis effluent being derived from the pyrolysis feedstock by the pyrolysis. When utilizing the specified pyrolysis feedstock and pyrolysis conditions of any of the preceding aspects, the pyrolysis effluent generally comprises ≥1.0 wt. % of $C_2$ unsaturates and ≥0.1 wt. % of TH, the weight percents being based on the weight of the pyrolysis effluent. Optionally, the pyrolysis effluent comprises ≥5.0 wt. % of $C_2$ unsaturates and/or ≥0.5 wt. % of TH, such as ≥1.0 wt. % TH. Although the pyrolysis effluent generally contains a mixture of the desired light olefins, SCN, SCGO, SCT, and unreacted components of the pyrolysis feedstock (e.g., water in the case of steam cracking, but also in some cases unreacted hydrocarbon), the relative amount of each of these generally depends on, e.g., the pyrolysis feedstock's composition, pyrolysis furnace configuration, process conditions during the pyrolysis, etc. The pyrolysis effluent is generally conducted away for the pyrolysis section, e.g., for cooling and separation.

In certain aspects, the pyrolysis effluent's TH comprise ≥10.0 wt. % of TH aggregates having an average size in the range of 10.0 nm to 300.0 nm in at least one dimension and an average number of carbon atoms ≥50, the weight percent being based on the weight of Tar Heavies in the pyrolysis effluent. Generally, the aggregates comprise ≥50.0 wt. %, e.g., ≥80.0 wt. %, such as ≥90.0 wt. % of TH molecules having a C:H atomic ratio in the range of from 1.0 to 1.8, a molecular weight in the range of 250 to 5000, and a melting point in the range of 100° C. to 700° C.

Although not required, the present process is compatible with cooling the pyrolysis effluent downstream of the pyrolysis furnace, e.g., the pyrolysis effluent can be cooled using a system comprising transfer line heat exchangers. For example, the transfer line heat exchangers can cool the process stream to a temperature in the range of about 700° C. to 350° C., in order to efficiently generate super-high pressure steam which can be utilized by the process or conducted away. If desired, the pyrolysis effluent can be subjected to direct quench at a point typically between the furnace outlet and the separation stage. The quench can be accomplished by contacting the pyrolysis effluent with a liquid quench stream, in lieu of, or in addition to the treatment with transfer line exchangers. Where employed in conjunction with at least one transfer line exchanger, the quench liquid is preferably introduced at a point downstream of the transfer line exchanger(s). Suitable quench fluids include liquid quench oil, such as those obtained by a downstream quench oil knock-out drum, pyrolysis fuel oil and water, which can be obtained from conventional sources, e.g., condensed dilution steam.

A separation stage can be utilized downstream of the pyrolysis furnace and downstream of the transfer line exchanger and/or quench point for separating from the pyrolysis effluent one or more of light olefin, SCN, SCGO, SCT, or water. Conventional separation equipment can be utilized in the separation stage, e.g., one or more flash drums, fractionators, water-quench towers, indirect condensers, etc., such as those described in U.S. Pat. No. 8,083,931. The separation stage can be utilized for separating an SCT-containing tar stream (the "tar stream") from the pyrolysis effluent. The tar stream typically contains ≥90.0 wt. % of SCT based on the weight of the tar stream, e.g., ≥95.0 wt. %, such as ≥99.0 wt. %, with the balance of the tar stream being particulates, for example. The tar stream's SCT generally comprises ≥10.0% (on a weight basis) of the pyrolysis effluent's TH. The tar stream can be obtained, e.g., from an SCGO stream and/or a bottoms stream of the steam cracker's primary fractionator, from flash-drum bottoms (e.g., the bottoms of one or more flash drums located downstream of the pyrolysis furnace and upstream of the primary fractionator), or a combination thereof. For example, the tar stream can be a mixture of primary fractionator bottoms and tar knock-out drum bottoms.

In certain embodiments, the SCT comprises ≥50.0 wt. % of the pyrolysis effluent's TH based on the weight of the pyrolysis effluent's TH. For example, the SCT can comprise ≥90.0 wt. % of the pyrolysis effluent's TH based on the weight of the pyrolysis effluent's TH. The SCT can have, e.g., (i) a sulfur content in the range of 0.5 wt. % to 7.0 wt. %, based on the weight of the SCT; (ii) a TH content in the range of from 5.0 wt. % to 40.0 wt. %, based on the weight of the SCT; (iii) a density at 15° C. in the range of 1.01 g/cm$^3$ to 1.19 g/cm$^3$, e.g., in the range of 1.07 g/cm$^3$ to 1.18 g/cm$^3$; and (iv) a 50° C. viscosity in the range of 200 cSt to $1.0\times10^7$ cSt. The amount of olefin in the SCT is generally ≤10.0 wt. %, e.g., ≤5.0 wt. %, such as ≤2.0 wt. %, based on the weight of the SCT. More particularly, the amount of (i) vinyl aromatics in the SCT and/or (ii) aggregates in the SCT which incorporate vinyl aromatics is generally ≤5.0 wt. %, e.g., ≤3 wt. %, such as ≤2.0 wt. %, based on the weight of the SCT.

In certain embodiments the SCT useful in the invention can have a density measured at 15° C. in the range of 1.01 g/cm3 to 1.19 g/cm3. The invention is particularly advantageous for SCT's having density at 15° C. that is ≥1.10 g/cm$^3$, e.g., ≥1.12, ≥1.14, ≥1.16, or ≥1.17 g/cm$^3$.

In certain embodiments the SCT useful in the invention can have a viscosity measured at 50° C. in the range of 200 cSt to $1.0\times10^7$ cSt. The invention is particularly advantageous for SCT's having viscosity at 50° C. that is $\geq1.0\times10^4$, e.g., $\geq1.0\times10^5$, $\geq1.0\times10^6$, or $\geq1.0\times10^7$ cSt.

Vapor-Liquid Separator

Optionally, the pyrolysis furnace has at least one vapor/liquid separation device (sometimes referred to as flash pot or flash drum) integrated therewith. The vapor-liquid separator is utilized for upgrading the pyrolysis feedstock before exposing it to pyrolysis conditions in the furnace's radiant section. It can be desirable to integrate a vapor-liquid separator with the pyrolysis furnace when the pyrolysis feedstock's hydrocarbon comprises ≥1.0 wt. % of non-volatiles, e.g., ≥5.0 wt. %, such as 5.0 wt. % to 50.0 wt. % of non-volatiles having a nominal boiling point ≥1400° F. (760° C.). The boiling point distribution and nominal boiling points of the pyrolysis feedstock's hydrocarbon are measured by Gas Chromatograph Distillation (GCD) according to the methods described in ASTM D-6352-98 or D-2887, extended by extrapolation for materials having a boiling point at atmospheric pressure ("atmospheric boiling point) ≥700° C. (1292° F.) It is particularly desirable to integrate a vapor/liquid separator with the pyrolysis furnace when the non-volatiles comprise asphaltenes, such as pyrolysis feedstock's hydrocarbon comprises ≥ about 0.1 wt. % asphaltenes based on the weight of the pyrolysis feedstock's hydrocarbon component, e.g., ≥ about 5.0 wt. %. Conventional vapor/liquid separation devices can be utilized, examples of which are disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; 6,632,351; 7,578,929; and 7,235,705, which are incorporated by reference herein in their entirety. Generally, when using a vapor/liquid separation device, the composition of the vapor phase leaving the device is substantially the same as the composition of the vapor phase entering the device, and likewise the composition of the liquid phase leaving the device is substantially the same as the composition of the liquid phase entering the device, i.e., the separation in the vapor/liquid separation device includes (or even consists essentially of) a physical separation of the two phases entering the device.

In aspects which include integrating a vapor/liquid separation device with the pyrolysis furnace, at least a portion of the pyrolysis feedstock's hydrocarbon is provided to the inlet of a convection section of a pyrolysis unit, where the hydrocarbon is heated so that at least a portion of the hydrocarbon is in the vapor phase. When a diluent (e.g., steam) is utilized, the pyrolysis feedstock's diluent is optionally (but preferably) added in this section and mixed with the hydrocarbon to produce the pyrolysis feedstock. The pyrolysis feedstock, at least a portion of which is in the vapor phase, is then flashed in at least one vapor/liquid separation device in order to separate and conduct away from the pyrolysis feedstock at least a portion of the pyrolysis feedstock's non-volatiles, e.g., high molecular-weight non-volatile molecules, such as asphaltenes. A bottoms fraction can be conducted away from the vapor-liquid separation device, the bottoms fraction comprising, e.g., ≥10.0% (on a wt. basis) of the pyrolysis feedstock's non-volatiles, such as ≥10.0% (on a wt. basis) of the pyrolysis feedstock's asphaltenes.

One of the advantages obtained when utilizing an integrated vapor-liquid separator is the lessening of the amount of $C_{6+}$ olefin in the SCT, particularly when the pyrolysis feedstock's hydrocarbon has a relatively high asphaltene content and a relatively low sulfur content. Such hydrocarbons include, for example, those having (i) ≥ about 0.1 wt. % asphaltenes based on the weight of the pyrolysis feedstock's hydrocarbon component, e.g., ≥ about 5.0 wt. %, (ii) a final boiling point ≥600° F. (315° C.), generally ≥950° F. (510° C.), or ≥1100° F. (590° C.), or ≥1400° F. (760° C.), and optionally (iii) ≤5 wt. % sulfur, e.g., ≤1.0 wt. % sulfur, such as ≤0.1 wt. % sulfur. It is observed that utilizing an integrated vapor-liquid separator when pyrolysing these hydrocarbons in the presence of steam, the amount of olefin the SCT is ≤10.0 wt. %, e.g., ≤5.0 wt. %, such as ≤2.0 wt. %, based on the weight of the SCT. More particularly, the amount of (i) vinyl aromatics in the SCT, and/or (ii) aggregates in the SCT which incorporate vinyl aromatics is ≤5.0 wt. %, e.g., ≤3 wt. %, such as ≤2.0 wt. %. While not wishing to be bound by any theory or model, it is believed that the amount of olefin in the SCT is lessened because precursors in the pyrolysis feedstock's hydrocarbon that would otherwise form $C_{6+}$ olefin in the SCT are separated from the pyrolysis feedstock in the vapor-liquid separator and conducted away from the process before the pyrolysis. Evidence of this feature is found by comparing the density of SCT obtained by crude oil pyrolysis. For conventional steam cracking of a crude oil fraction, such as vacuum gas oil, the SCT is observed to have an API gravity (measured at 15.6° C.) the range of about −1° API to about 6° API. API gravity is an inverse measure of the relative density, where a lesser (or more negative) API gravity value is an indication of greater SCT density. When the same hydrocarbon is pyrolysed utilizing an integrated vapor-liquid separator operating under the specified conditions, the SCT density is increased, e.g., to an API gravity ≤−7.5° API, such as ≤−8.0° API, or ≤−8.5° API.

Another advantage obtained when utilizing a vapor/liquid separator integrated with the pyrolysis furnace is that it increases the range of hydrocarbon types available to be used directly, without pretreatment, as hydrocarbon components in the pyrolysis feedstock. For example, the pyrolysis feedstock's hydrocarbon component can comprise ≥50.0 wt. %, e.g., ≥75.0 wt. %, such as ≥90.0 wt. % (based on the weight of the pyrolysis feedstock's hydrocarbon) of one or more crude oils, even high naphthenic acid-containing crude oils and fractions thereof. Feeds having a high naphthenic acid content are among those that produce a high quantity of SCT and are especially suitable when at least one vapor/liquid separation device is integrated with the pyrolysis furnace. If desired, the pyrolysis feedstock's composition can vary over time, e.g., by utilizing a pyrolysis feedstock having a first hydrocarbon during a first time period and then, during a second time period, substituting a second hydrocarbon for at least a portion of the first hydrocarbon. The first and second hydrocarbons can be substantially different hydrocarbons or substantially different hydrocarbon mixtures. The first and second periods can be of substantially equal or different durations. Alternating first and second periods can be conducted in sequence continuously or semi-continuously (e.g., in "blocked" operation) if desired. This can be utilized for the sequential pyrolysis of incompatible first and second hydrocarbon components (i.e., where the first and second hydrocarbon components are mixtures that are not sufficiently compatible to be blended under ambient conditions). For example, the pyrolysis feedstock can comprise a first hydrocarbon during a first time period and a second hydrocarbon (one that is substantially incompatible with the first hydrocarbon) during a second time period. The first hydrocarbon can comprise, e.g., a virgin crude oil. The second hydrocarbon can comprise SCT.

In certain aspects a pyrolysis furnace is integrated with a vapor-liquid separator device as illustrated schematically in FIG. 1. A hydrocarbon feedstock or feed is introduced into furnace 1 via an entry line (labeled but not numbered), the hydrocarbon feed being heated by indirect contact with hot flue gasses in the upper region (not numbered) farthest from the radiant section 40 of the furnace. The heating is accomplished by passing at least a portion of the hydrocarbon feed through a bank of heat exchange tubes 2 located within the convection section 3 of the furnace 1. The heated hydrocarbon feed typically has a temperature in the range of about 300° F. to about 500° F. (150° C. to 260° C.), such as about 325° F. to about 450° F. (160° C. to 230° C.), for example about 340° F. to about 425° F. (170° C. to 220° C.). Diluent, in this case primary dilution steam, is introduced via line 17 and valve 15 and is combined with the heated hydrocarbon feed in sparger 8 and double sparger 9. Additional fluid, such as one or more of additional hydrocarbon, steam, and water, such as boiler feed water, can be introduced into the heated hydrocarbon via valve 14 and sparger 4. Generally, the primary dilution steam is injected into the pyrolysis hydrocarbon feed before the combined hydrocarbon-steam mixture (the pyrolysis feedstock) enters the convection section at 11, for additional heating by flue gas. The primary dilution steam generally has a temperature greater than that of the pyrolysis feedstock's hydrocarbon, in order to at least partially vaporize the pyrolysis feedstock's hydrocarbon. The pyrolysis feedstock is heated again in the convection section 3 of the pyrolysis furnace 1 before the vapor-liquid separation, e.g., by passing the pyrolysis feedstock through a bank of heat exchange tubes 6.

The pyrolysis feedstock leaves the convection section as a re-heated pyrolysis feedstock 12, which is then fed to vapor-liquid separator 5. Typically, the temperature of the re-heated pyrolysis feedstock 12 is controlled in the range of about 600° F. to about 1000° F. (315° C. to 540° C.), in response, e.g., to changes of the concentration of volatiles in the pyrolysis feedstock. The temperature can be selected to maintain a liquid phase in line 12 and downstream thereof to reduce the likelihood of coke formation on exchanger tube walls and in the vapor-liquid separator. The pyrolysis feedstock's temperature can be controlled by a control system 7, which generally includes a temperature sensor and a control device, which can be automated by way of a computer. The control system 7 communicates with the fluid valve 14 and the primary dilution steam valve 15 in order to regulate the amount of fluid and primary dilution steam entering dual sparger 9.

In some embodiments, the re-heated pyrolysis feedstock 12 may be further heated by secondary dilution steam introduced via line 18. Optionally, the secondary dilution steam is split into (i) a first stream 19 which is mixed with the re-heated pyrolysis feedstock 12 before vapor-liquid separation, and (ii) a second bypass stream 21 which bypasses the vapor-liquid separation and is instead mixed with a vapor phase that is separated from the re-heated pyrolysis feedstock 12 in the vapor-liquid separator. The mixing is carried out before the vapor phase is cracked in the radiant section of the furnace. In certain aspects, the ratio of the first stream 19 to the second bypass stream 21 is 1:20 to 20:1, e.g., 1:2 to 2:1.

The secondary dilution steam (or the first stream 19 thereof) is mixed with the re-heated pyrolysis feedstock 12 to form a flash stream 20 before flashing in vapor-liquid separator 5. Optionally, the secondary dilution steam is superheated in a superheater section 16 of the furnace convection section before splitting and mixing with the heavy hydrocarbon mixture. In some embodiments, such as that shown in FIG. 1, the superheated secondary dilution steam is passed through an intermediate desuperheater 25, where a fine mist of desuperheater water 26 can be added, which rapidly vaporizes and reduces the steam temperature. This allows the superheater 16 outlet temperature to be controlled at a constant value, independent of furnace load changes, coking extent changes, excess oxygen level changes, and other variables. When used, desuperheater 25 generally maintains the temperature of the secondary dilution steam in the range of about 800° F. to about 1100° F. (425° C. to 590° C.). In addition to maintaining a substantially constant temperature of the mixture stream 12 entering the flash/separator vessel, it is generally also desirable to maintain a constant hydrocarbon partial pressure of the flash stream 20 in order to maintain a substantially constant ratio of vapor to liquid in the flash/separator vessel. By way of examples, a substantially constant hydrocarbon partial pressure can be maintained through the use of control valve 36 on the vapor phase line 13 and by controlling the ratio of steam to hydrocarbon pyrolysis feedstock in stream 20. Typically, the hydrocarbon partial pressure of the flash stream in the present invention is set and controlled in a range of about 4 psia to about 25 psia (25 kPa to 175 kPa), such as in a range of about 5 psia to about 15 psia (35 kPa to 100 kPa), for example in a range of about 6 psia to about 11 psia (40 kPa to 75 kPa).

The optional addition of the secondary dilution steam to the pyrolysis feedstock 12 aids the vaporization of most volatile components of the pyrolysis feedstock before the flash stream 20 enters the vapor-liquid separation vessel 5. The pyrolysis feedstock 12 or the flash stream 20 is then flashed in the vessel 5 to separate the feedstock into two phases: a vapor phase comprising predominantly volatile hydrocarbons and steam, and a liquid phase comprising predominantly non-volatile hydrocarbons. Conventional vapor-liquid separation conditions can be utilized in vapor-liquid separation vessel 5, such as those disclosed in U.S. Pat. No. 7,820,035. When the pyrolysis feedstock's hydrocarbon component comprises one or more crude oil or fractions thereof, the vapor/liquid separation device can operate at a temperature in the range of from about 600° F. to about 950° F. (about 350° C. to about 510° C.) and a pressure in the range of about 275 kPa to about 1400 kPa, e.g., a temperature in the range of from about 430° C. to about 480° C. and a pressure in the range of about 700 kPa to 760 kPa.

The vapor phase separated in the vapor-liquid separation vessel 5 may contain, for example, about 55% to about 70% hydrocarbon (by weight) and about 30% to about 45% steam (by weight). The final boiling point of the vapor phase is generally ≤1400° F. (760° C.), such as ≤1100° F. (590° C.), for example below about 1050° F. (565° C.), or ≤ about 1000° F. (540° C.). An optional centrifugal separator 38 can be used for removing from the vapor phase any entrained and/or condensed liquid, which can then be recycled to the separation vessel 5.

The vapor phase separated in the vapor-liquid separation vessel 5 is removed from vessel 5 as an overhead vapor stream 13, which is optionally mixed with the by-pass stream 21 and is then transferred through valve 36 and crossover pipes 24 to the radiant section 40 of the pyrolysis furnace for cracking. Optionally, the vapor stream 13 is passed through a convection section tube bank 23 of the furnace, e.g., at a location proximate to the radiant section of the furnace, for additional heating before being fed to the radiant section 40. Typically, the vapor stream 13 is heated to a temperature in the range of about 800° F. to about 1300° F. (425° C. to 705° C.) in the tube bank 23.

The liquid phase of the flashed mixture stream is collected in the bottom section 35 of the vapor-liquid separation vessel 5 and removed from vessel 5 as a bottoms stream 27 and conveyed to a cooler 28 via pump 37. The resultant cooled bottoms stream 29 can then be split into a recycle stream 30 and an export stream 22. Recycle liquid in line 30 can be returned to vessel 5 proximate to bottom section 35, while export stream (also referred to as vacuum tower bottoms) is mixed with a fluxant, such as SCGO, and sent to storage for use as heavy fuel oil.

As indicated above the vapor phase stream 13 entering the radiant section 40 is typically at a temperature in the range of about 800° F. to about 1300° F. (425° C. to 705° C.). The vapor phase stream is further heated in the radiant section, typically to temperature in the range of about 1100° F. to about 1650° F. (600° C. to 900° C.) such that the pyrolysis feedstock is cracked in the presence of steam to produce (i) vapor-phase products comprising one or more of acetylene, ethylene, propylene, and butenes, and (ii) liquid-phase products comprising one or more of $C_{5+}$ molecules including pyrolysis tar.

The effluent from the radiant section 40 is fed via line 41 to a transfer-line heat exchanger where the effluent can be rapidly cooled. Indirect cooling can be used, e.g., using water from a steam drum 47, via lines 44 and 45, in a thermosyphon arrangement to generate saturated steam. Make-up water can be added to the drum 47 via line 46. The saturated steam is conducted away from the drum in line 48 and can be superheated in a high pressure steam superheater bank 49. A desuperheater can be used to control the temperature of the steam exiting the superheater bank 49. The desuperheater can include a control valve/water atomizer nozzle 51, line 50 for transferring steam to the desuperheater, and line 52 for transferring steam away from the desuperheater. After partial heating, the high pressure steam exits the convection section via line 50 and water from nozzle 51 is added (e.g., as a fine mist) which rapidly vaporizes and reduces the temperature of the steam. The high pressure steam can be returned to the convection section via line 52 for further heating. The amount of water added to the superheater can control the temperature of the steam withdrawn via line 53. The steam in line 53 can be conducted away for further use, e.g., as a utility stream.

After cooling in transfer-line exchanger 42, the pyrolysis effluent is conducted away via line 43, e.g., for separating from the pyrolysis effluent one or more of molecular hydrogen, water, unconverted feed, SCT, gas oils, pyrolysis gasoline, ethylene, propylene, and $C_4$ olefins.

In aspects where a vapor-liquid separator is integrated with the pyrolysis furnace, the SCT generally comprises ≥50.0 wt. %, such as ≥90.0 wt. %, of the pyrolysis effluent's TH based on the weight of the pyrolysis effluent's TH. For example, the SCT can have (i) a TH content in the range of from 5.0 wt. % to 40.0 wt. %, based on the weight of the SCT; (ii) an API gravity (measured at a temperature of 15.8° C.) of ≤−7.5° API, such as ≤−8.0° API, or ≤−8.5° API; and (iii) a 50° C. viscosity in the range of 200 cSt to $1.0\times10^7$ cSt. The SCT can have, e.g., a sulfur content that is >0.5 wt. %, e.g., in the range of 0.5 wt. % to 7.0 wt. %, based on the weight of the SCT. In aspects where pyrolysis feedstock does not contain an appreciable amount of sulfur, the SCT can comprise ≤0.5 wt. % sulfur, e.g., ≤0.1 wt. %, such as ≤0.05 wt. % sulfur, based on the weight of the SCT. The amount of olefin in the SCT is generally ≤10.0 wt. %, e.g., ≤5.0 wt. %, such as ≤2.0 wt. %, based on the weight of the SCT. More particularly, the amount of (i) vinyl aromatics in the SCT is generally ≤5.0 wt. %, e.g., ≤3 wt. %, such as ≤2.0 wt. % and/or (ii) aggregates in the SCT which incorporate vinyl aromatics is generally ≤5.0 wt. %, e.g., ≤3 wt. %, such as ≤2.0 wt. %, the weight percents being based on the weight of the SCT.

Generally, SCT has high solubility blending number values, for example, $S_{BN}$>135, and high incompatibility number, for example, $I_N$>80, making it difficult to blend with other heavy hydrocarbons. In aspects where a vapor-liquid separator is integrated with the pyrolysis furnace, it has been observed that SCT has even higher $S_{BN}$ and $I_N$ making these SCT particularly difficult to blend and hydroprocess. For example, SCT can have $S_{BN}$>170 or $S_{BN}$>200. SCT can have $I_N$>110, >120, or $I_N$>130.

EXAMPLES

The invention will now be more particularly described with reference to the following non-limiting Examples and FIGS. 3 to 16 of the accompanying drawings.

In the following examples, the hydroprocessing experiments are conducted in a tubular, fixed bed, high pressure reactor under isothermal conditions. The reactor is composed of a feed preheat section welded via a Swagelok fitting to a main isothermal reaction section. The feed preheat section comprises a stainless steel tube with a 0.25 inch outside diameter and a wall thickness of 0.035 inch pressure rated to 5100 psi, whereas the reaction section comprises a stainless steel tube with a 0.375 inch outside diameter and a wall thickness of 0.049 inch pressure rated to 4800 psi. The feed section does not contain any catalyst or inert material and is separated by an inserted mesh from the reaction section to prevent catalyst back flow. The isothermal section of the reactor is packed with 18 inches of 10-14 mesh size catalyst with the remainder filled with an inert packing such as 10-14 mesh size quartz. The packed reactor is mounted vertically in a sleeve-type furnace assembly with the feed entering through the feed preheat section at the top and flowing downward through the main reaction section.

The reactor is purged with $N_2$ or $H_2$ for a minimum of 1 hour to remove air from the reactor. The unit is then leak tested under $H_2$ flow by gradually increasing the reactor pressure up to 5% higher than the desired run pressure. All of the connections in the unit are checked with a leak detector and the unit passes the leak test if the set pressure does not decline more than 1% at the end of an hour waiting period.

Once the unit passes the leak test, the catalyst is sulfided by using a 80% Isopar/20% wt dimethyldisulfide (DMDS) solution according to the following protocol:

- Start feed pump at specified rate (1 cc/min or WHSV=1 hr−1).
- Run pump until reactor is liquid full (check the KO pot for sample collecting to verify).
- Reduce feed pump flow to specified rate (0.042 cc/min).
- Start hydrogen flow at specified rate (20 sccm).
- Start furnace temperature ramps as shown in Table 1. Use the same ramp parameters for all furnace zones.

TABLE 1

| | Set Point [° C.] | Ramp Rate [° C./hr] | Hold Time [hr] |
|---|---|---|---|
| Phase 1 | 110 | 60 | 1 |
| Phase 2 | 240 | 60 | 12 |
| Phase 3 | 340 | 60 | 60 |

- When the sulfiding is complete (the end of Phase 3), clean the pump with solvent (TMB, A200 or similar).
- Decrease the reactor temperature to 200° C. and flush the system with the feed (tar+solvent) or a solvent (TMB, A200 or similar).
- Restart hydrogen flow for 1 hour to purge any remaining solvent/sulfiding solution.

Once sulfiding is complete, a tar/solvent mixture is fed to the reactor for the tar hydroprocessing tests. The very first product is discarded and not used for analytical measurements because of the possibility of contamination (with sulfiding solutions or rinsing solution).

Example 1

Several pyrolysis tar hydroprocessing experiments were carried out in the reactor described above at 1500 psig (10443 kPa-a) and 1800 psig (12512 kPa-a) with WHSV of 0.3, 0.5, and 1 $hr^{-1}$. The rest of the conditions were selected to be the same in order to make fair comparisons: 400° C. and 3:1 ratio of $H_2$ per barrel of feed.

Feed to the reactor for both experiments was 40 wt % utility fluid and 60 wt % steam cracker tar. The raw tar sample was heated in a ventilated oven at 100° C. for a minimum of 4 hours prior to mixing with the utility fluid solvent. Since the raw tar feed has a higher $S_{BN}$ number compared to the recycle utility fluid solvent, the solvent was added into the pre-heated tar sample slowly by mixing. The tar and utility fluid solvent mixture was stirred with a mechanical agitator until a homogenous feed mixture was obtained.

Figure 3:
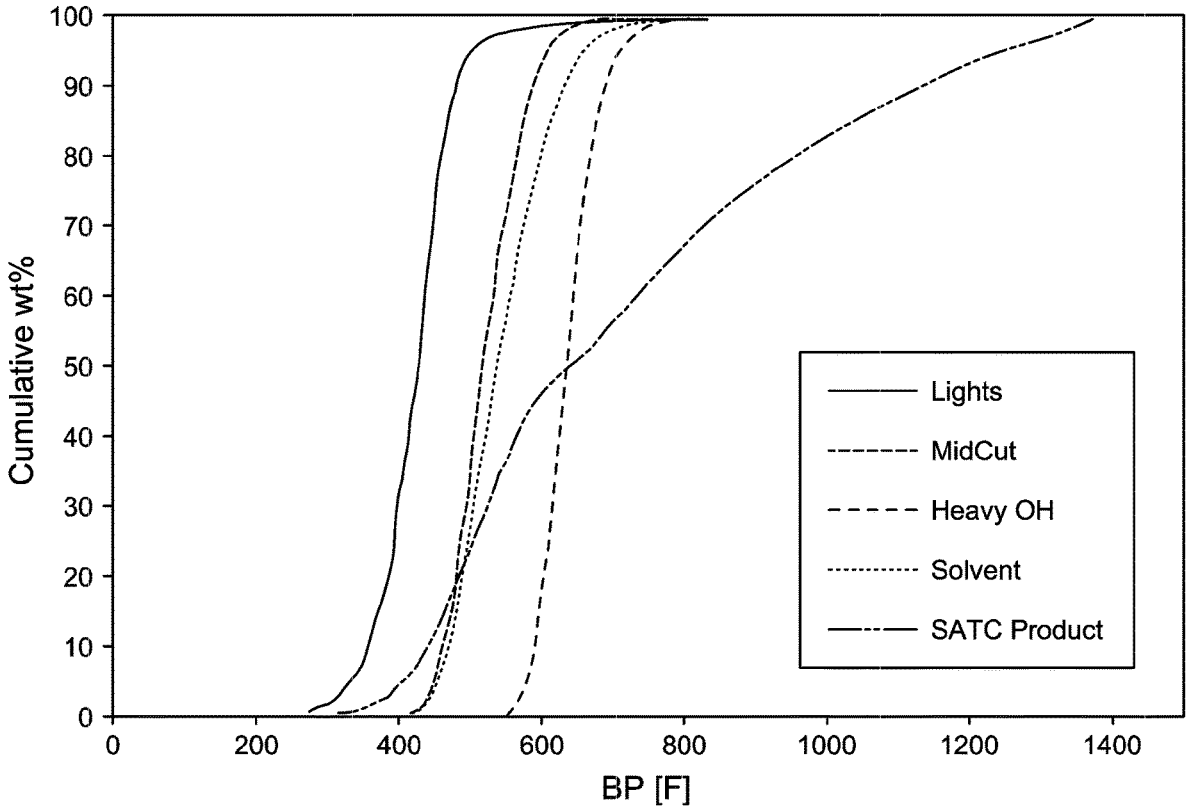
FIG. 3 shows simulated distillation curves for the lights, midcut, heavy overhead (HOH) and bottoms fractions of the total liquid product of Example 1.
Figure 4A:
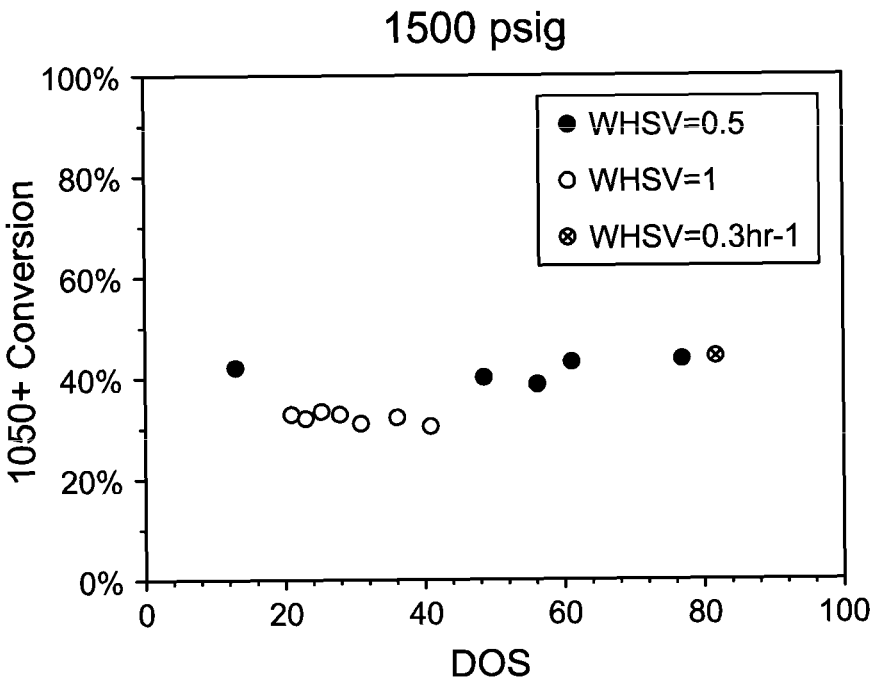
FIGS. 4(*a*) and (*b*) are graphs of % conversion of hydrocarbons boiling at 1050° F.+(566° C.+) against days on stream in the hydroprocessing tests of Example 1 at pressures of 1500 psig (10443 kPa-a) and 1800 psig (12512 kPa-a), respectively and at WHSV values of 1, 0.5 and 0.3 $hr^{-1}$.
Figure 4B:
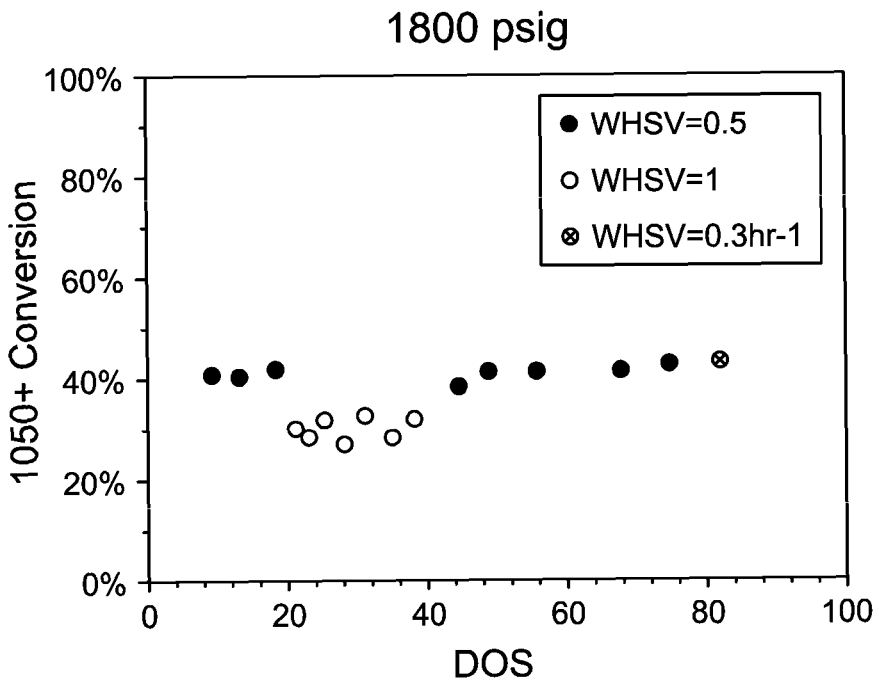

The feed mixture was hydroprocessed and reactor effluent cooled to room temperature (23° C.). Total vapor product was separated from the reactor effluent at atmospheric pressure. The remaining total liquid product (TLP) was divided into four boiling range fractions and analyzed for composition. The four TLP fractions were Lights, Midcut, Heavy overhead (HOH) and Bottoms. Simulated Distillation (SimDis) indicating the boiling ranges of the Lights, Midcut and HOH are shown in FIG. 3. The Bottoms fraction contained the remaining higher boiling molecules with boiling point (BP) ≥1050° F. Table 2 indicates the composition analysis for the four TLP fractions from the 1800 psi experiment.

Once the TLP was fractioned and analyzed, the Midcut and HOH fractions were mixed together (in ratio equal to their TLP wt % ratio, that is, wt % Midcut in the TLP/wt % HOH in the TLP) to form utility fluid solvent that was also analyzed for composition. The analysis results of the utility fluid from one 1800 psi (12512 kPa-a) experiment are summarized in Table 2. For clarity, the utility fluid in Table 2 has a Midcut/HOH weight ratio of 52.6/9.6.

Finally, an example upgraded tar product (also called Solvent Assisted Tar Conversion Product or SATC Product) was mixed from Lights, utility fluid (composed of Midcut/HOH), and Bottoms. It was observed in these experiments that more utility fluid boiling range molecules were produced than were added to the feed. Therefore, prior to forming the upgraded tar product from the TLP in these experiments, an amount of 40 wt % of the TLP was removed as recovered utility fluid since the feed to the reactors was 40 wt % utility fluid. The remaining utility fluid molecules together with the Lights, and Bottoms from the TLP formed the upgraded tar product in these experiments. The upgraded tar product in Table 2 was 14.1 wt % Lights, 37.1 wt % utility fluid, and 48.9 wt % Bottoms. The upgraded tar product was analyzed for composition. The analysis results of the utility fluid and SATC product from one 1800 psi (12512 kPa-a) experiment are summarized in Table 2.

TABLE 2

| | WHSV 0.5 $hr^{-1}$ Lights | Temp 400° C. Midcut | Pressure 1800 psi HOH | H2/Feed Ratio 5500 scfb Bottoms | Utility Fluid | Upgraded Tar Product |
|---|---|---|---|---|---|---|
| wt % in total | 8.4% | 52.6% | 9.6% | 29.3% | | |
| S wt % | 0.011% | 0.018% | 0.137% | 0.280% | 0.035% | 0.128% |
| H wt % | 11.3% | 10.7% | 9.6% | 8.2% | 10.5% | 9.5% |
| API | 25.2 | 17.7 | 8.8 | −3.9 | 16.0 | 7.7 |
| Density [g/cm3] | 0.902 | 0.948 | 1.008 | 1.109 | 0.958 | 1.016 |
| Viscosity @ 50° C. (cSt) | | | | | | 25 |

The light gas products were analyzed with a GCMS at the base reaction conditions: WHSV=0.5 $hr^{-1}$/T=400 C.°/P=1000 psig/Feed $H_2$=3000 scf/barrel of tar with RT621 catalyst (CoMo). The light gas products were determined as 38 wt % $CH_4$, 30 wt % $C_2H_6$, 19 wt % $C_3H_8$ and 13 wt % $C_4H_{10}$ and this composition can be used to make estimation for the $H_2$ consumption by the light gas. The light gas composition might change based on the reaction conditions.

For comparative purposes, the raw (not mixed with utility fluid) steam cracker tar was divided into the same boiling range fractions used to fractionate the TLP and analyzed for composition. Results of the analysis are summarized in Table 3. (The raw steam cracker tar did not contain any molecules boiling the Lights range.) The steam cracker tar used had a density of 1.176 g/$cm^3$ and a viscosity measured at 50° C. of $1.6\times10^5$ cSt. The raw steam cracker tar is composed mostly of bottoms (90%) and the nature of the bottoms is highly aromatic as evident from the very low H-content of 5.9 wt %. Most of the sulfur is carried within the bottoms as 93 wt % of the total sulfur containing molecules.

TABLE 3

| Info | Raw Tar "MidCut" | Raw Tar "HOH" | Raw Tar "Bottoms" | Raw Tar |
|---|---|---|---|---|
| wt % in Raw tar | 7.53% | 3.33% | 89.14% | 100.00% |
| API | 9.5 | 0.8 | −14.3 | −11.3 |
| Density [g/cm3] | 1.003 | 1.069 | 1.206 | 1.176 |
| H wt % NMR | 8.082% | 7.188% | 5.917% | 6.060% |
| wt % H in total | 9.94% | 3.91% | 86.15% | 6.12% |
| S wt % | 2.360% | 4.257% | 4.520% | 4.360% |
| wt % Sulfur in total | 4.09% | 3.26% | 92.65% | 4.35% |
| Viscosity @ 50° C. cSt | 2.0495 | 5.2915 | NA | 160000 |
| 1050+ wt % | 3.15% | 4.67% | 26.38% | 21.01% |
| 750+ wt % | 11.84% | 14.67% | 69.74% | 57.44% |
| 750 − 1050 wt % | 8.70% | 10.00% | 43.36% | 36.43% |

The H-content was measured via a bench top proton NMR (H-NMR). The equation for $H_2$ consumption by the total liquid product is as follows:

$$H_2cons.(sccm) = \vartheta_{Feed\xi}\left(\frac{cm^3}{min}\right)\rho_{Feed\xi}\left(\frac{g}{cm^3}\right)[H_{TLP} - H_{Feed\xi}](wt\ \%)\left[\frac{22.4*10^3(cm^3)}{MW_{H_2}\left(\frac{g}{mol}\right)}\right]$$

-continued $$H_2cons.(SCFB\ Tar) = \frac{H_2cons.(sccm)*\left[\frac{1\ ft^3}{(30.48)^3 cm^3}\right]}{\left\{\frac{\vartheta_{Feed\xi}\left(\frac{cm^3}{min}\right)\rho_{Feed\xi}\left(\frac{g}{cm^3}\right)Tar\ wt_{Feed\xi}\ \%}{\left[\frac{42\ gal}{1\ barrel}\right]\left[\frac{3785\ cc}{1\ gal}\right]\rho_{Tar}\left(\frac{g}{cm^3}\right)}\right\}}$$

Feed ξ is the liquid feed mixture of tar and solvent.

The reactor performance was monitored and evaluated by using the conversion levels (1050° F.+[566° C.+], 750-1050° F. [399-566° C.] range and sulfur), $H_2$ consumption, and compatibility indexes ($I_N$ and $S_{BN}$). The 1050° F.+(566° C.+) conversion levels of the two reactors operating at 1500 psig (10443 kPa-a) and 1800 psig (12512 kPa-a) are shown as a function of days on stream (DOS) in FIGS. 4(*a*) and 4(*b*) respectively. Throughout the run, the feed was sent to the reactor with three weight hourly space velocity values of 1, 0.5 and 0.3 $hr^{-1}$. Decreasing the WHSV from 1 to 0.5 $hr^{-1}$ was effective in increasing the 1050° F.+conversion. Counterintuitively, decreasing the flow rate lost its impact when the WHSV was decreased to 0.3 $hr^{-1}$. More importantly, decreasing the feed flow rate to low levels, e.g. WHSV <0.3 $hr^{-1}$, will lead to reactor plugging due to incompatibility and coking as mentioned earlier.

Figure 5A:
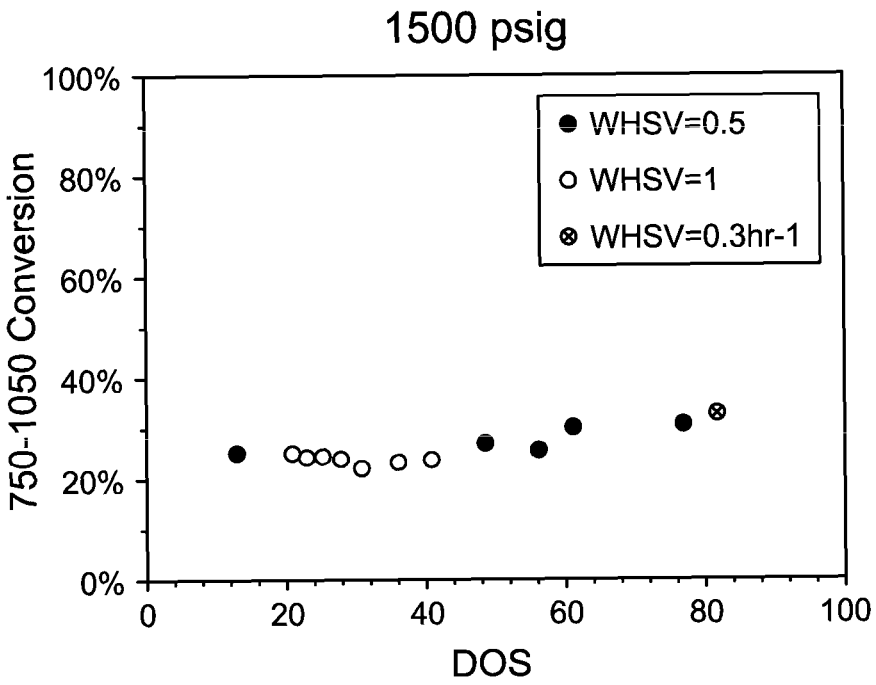
FIGS. 5(*a*) and (*b*) are graphs of % conversion of hydrocarbons boiling in the range 750 to 1050° F. (399 to 566° C.) against days on stream in the hydroprocessing tests of Example 1 at pressures of 1500 psig (10443 kPa-a) and 1800 psig (12512 kPa-a), respectively and at WHSV values of 1, 0.5 and 0.3 $hr^{-1}$.
Figure 5B:
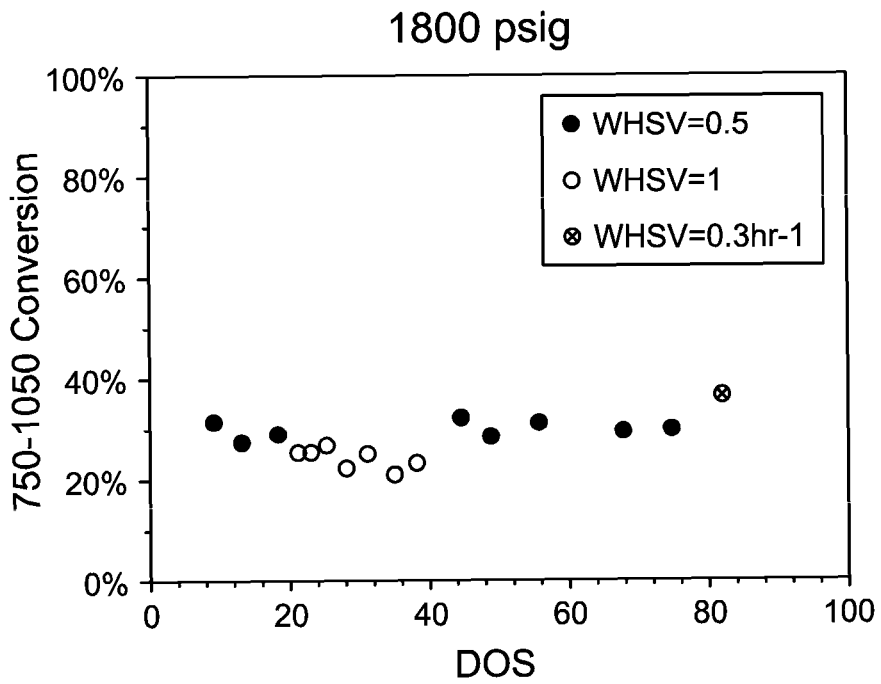

The conversion levels for the molecules between boiling in the range from 750 to 1050° F. (399 to 566° C.) were also monitored in order to observe the changes in the lighter fractions of the SATC product. The molecules in the BP range of 750-1050° F. are desired to remain untouched in order to preserve aromaticity and high solubility power. However, these 750-1050° F. molecules also get converted due to some hydrogenation and cracking. The residence time had a significant impact on 750-1050° F. conversion, especially for the lowest feed flow rate as shown in FIG. 5(*a*) for conversion at 1500 psig (10443 kPa-a) and in FIG. 5(*b*) for conversion at 1800 psig (12512 kPa-a).

Figure 6A:
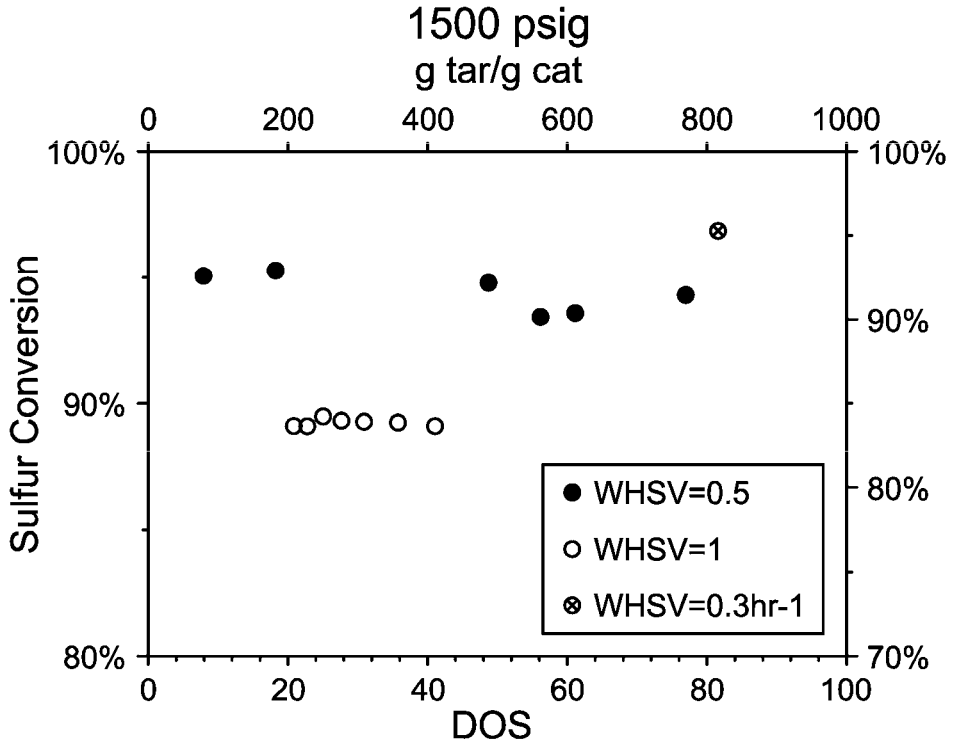
FIGS. 6(*a*) and (*b*) are graphs of % conversion of sulfur against days on stream in the hydroprocessing tests of Example 1 at pressures of 1500 psig (10443 kPa-a) and 1800 psig (12512 kPa-a), respectively and at WHSV values of 1, 0.5 and 0.3 $hr^{-1}$.
Figure 6B:
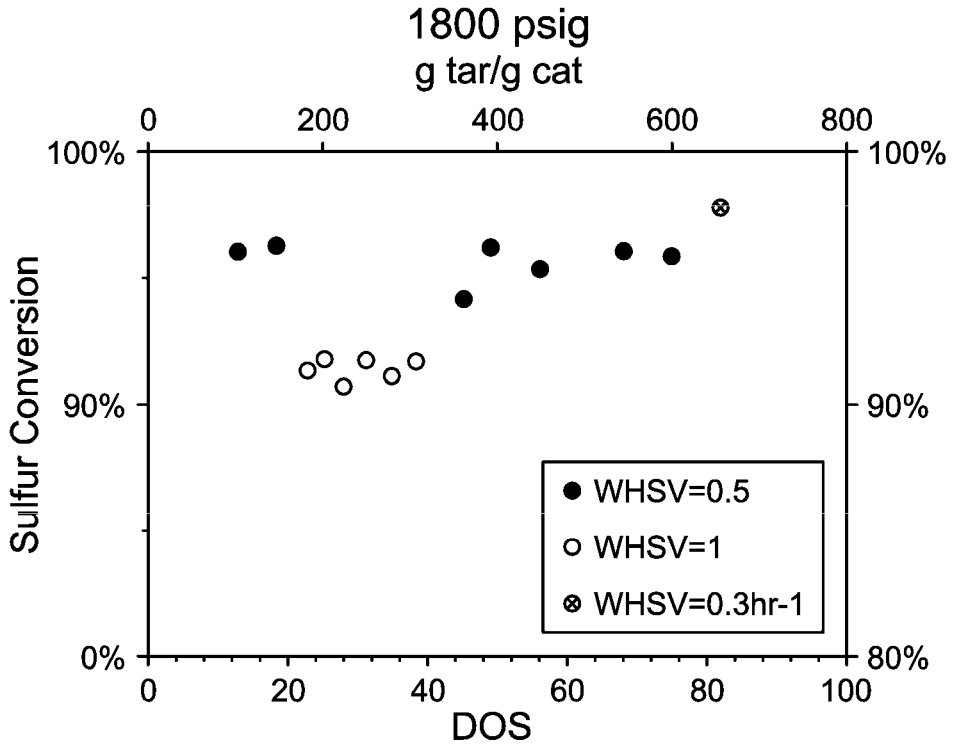

The sulfur conversion levels together with the sulfur wt % in the total liquid product (TLP) are captured in FIG. 6(*a*) for conversion at 1500 psig (10443 kPa-a) and in FIG. 6(*b*) for conversion at 1800 psig (12512 kPa-a).

Figure 7A:
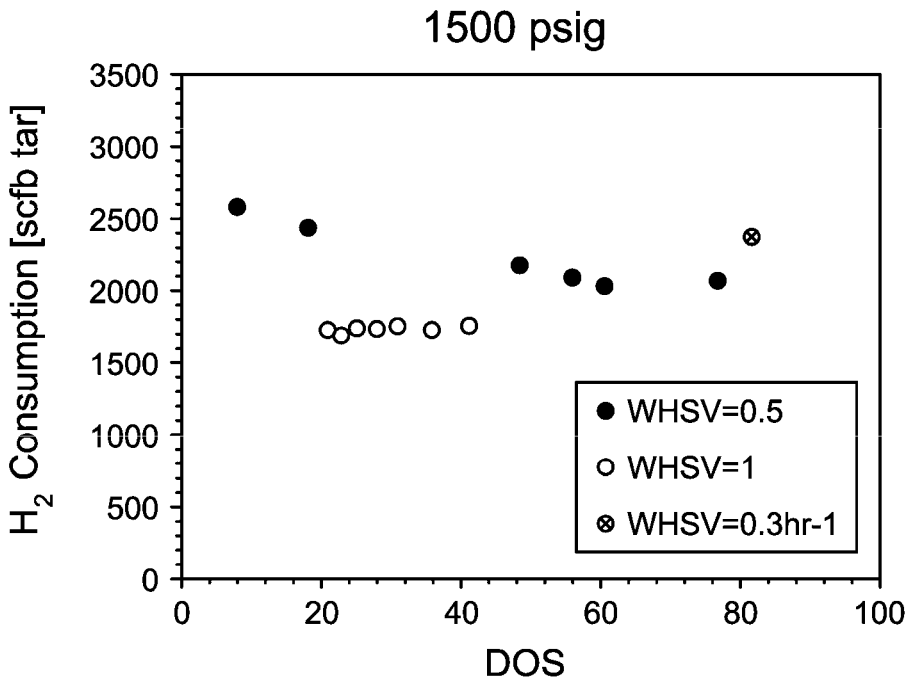
FIGS. 7(*a*) and (*b*) are graphs of $H_2$ consumption against days on stream in the hydroprocessing tests of Example 1 at pressures of 1500 psig (10443 kPa-a) and 1800 psig (12512 kPa-a), respectively and at WHSV values of 1, 0.5 and 0.3 $hr^{-1}$.
Figure 7B:
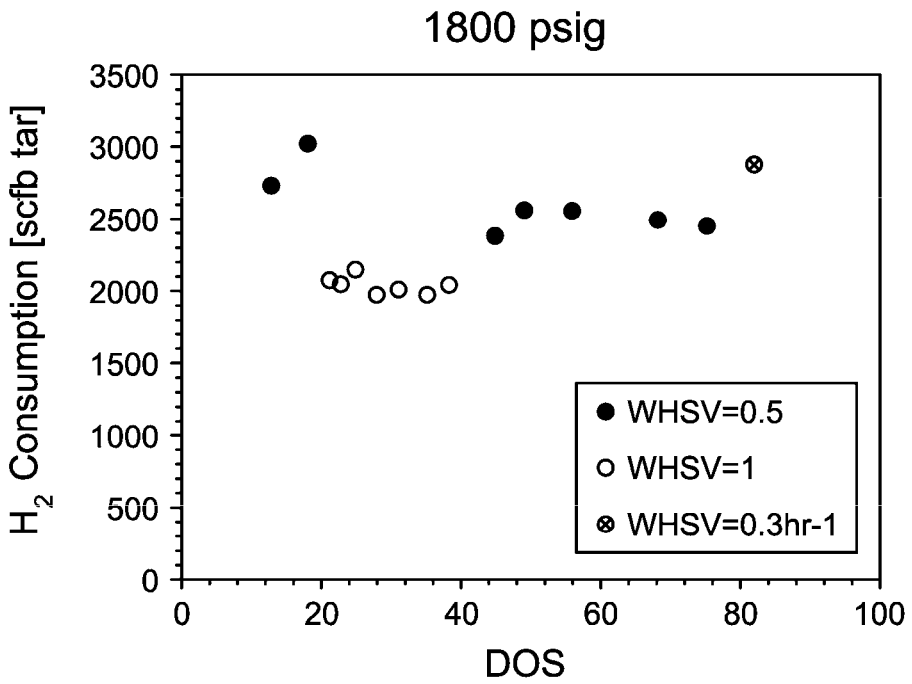

The impact of elevated reactor pressure was observed with the $H_2$ consumption comparison of the 1500 and 1800 psig runs shown FIGS. 7(*a*) and 7(*b*). The $H_2$ consumption was increasing between the two runs from 266 to 484 scf $H_2$ per barrel of tar for 1 and 0.3 $hr^{-1}$ WHSV values as shown in FIG. 7(*a*) for the 1500 psig run and FIG. 7(*b*) for the 1800 psig run. This approach of operating a single reactor at elevated pressure provides benefits of decreased product density by additional hydrogenation. However, it appears the hydrogenation is across the whole boiling point range in this case so that smaller molecules in the lower boiling point range (<750° F.) are also being hydrogenated.

Figure 8:
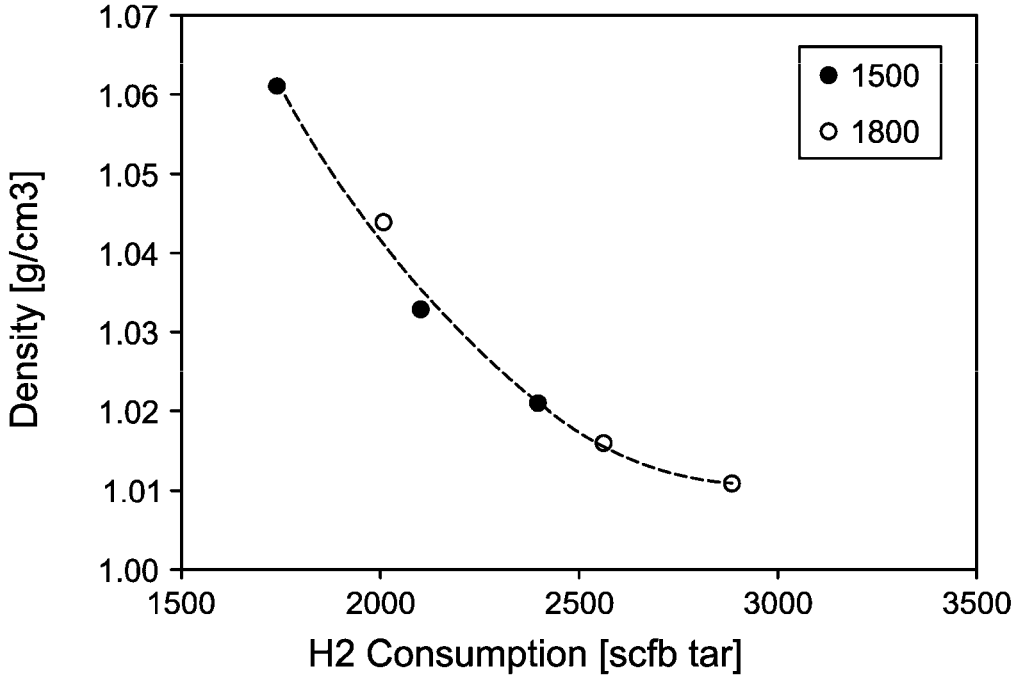
FIG. 8 is a graph of product density against $H_2$ consumption at pressures of 1500 psig (10443 kPa-a) and 1800 psig (12512 kPa-a) in the hydroprocessing tests of Example 1.
Figure 9A:
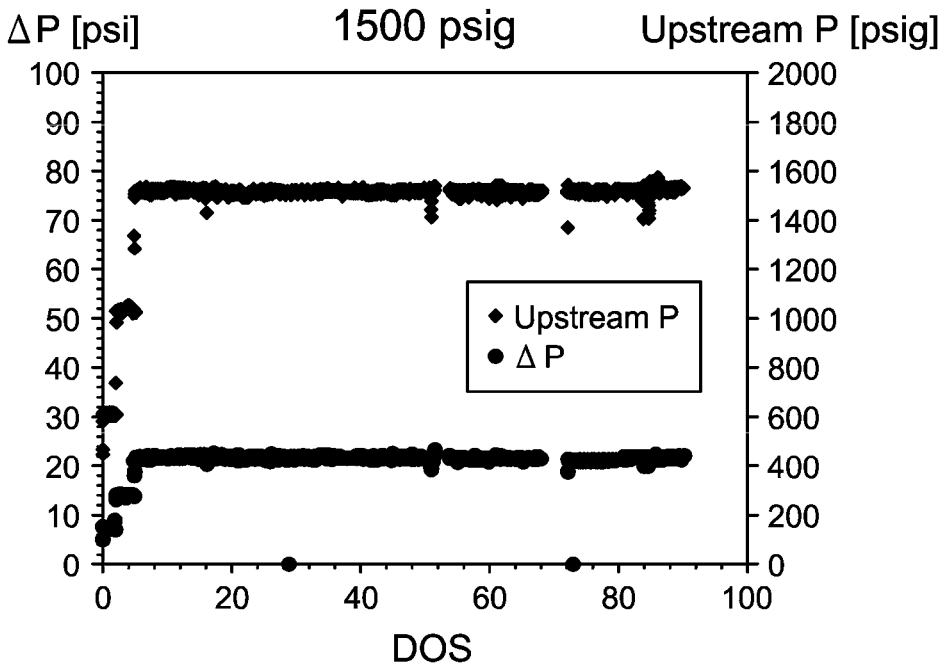
FIGS. 9 (*a*) and (*b*) are graphs of the pressure difference between the inlet and outlet of the hydroprocessing reactor against days on stream in the hydroprocessing tests of Example 1 at pressures of 1500 psig (10443 kPa-a) and 1800 psig (12512 kPa-a), respectively.
Figure 9B:
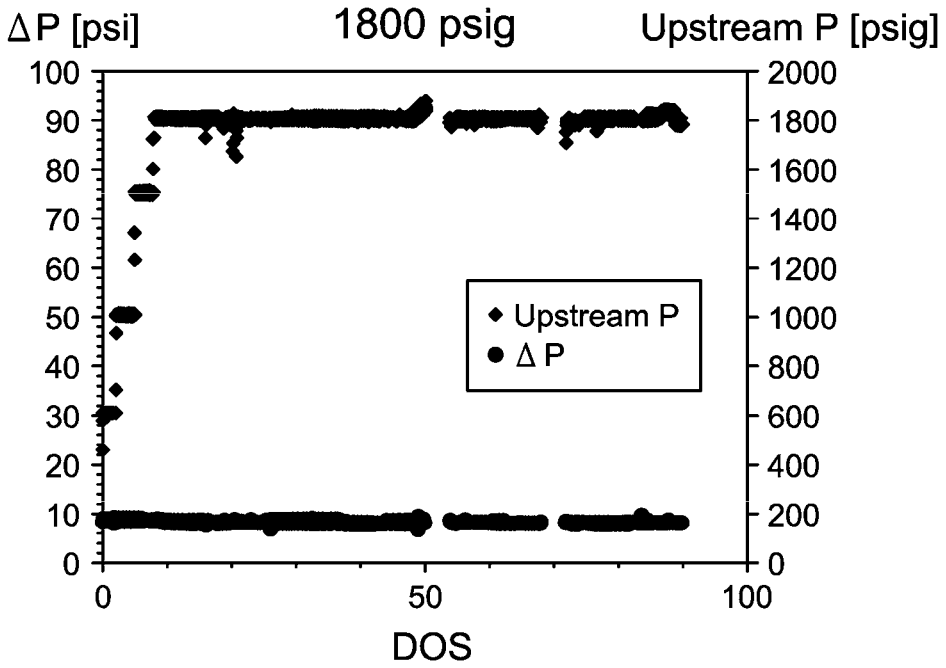

Density values of the upgraded tar products for each of 0.3, 0.5, and 1 hr−1 WHSV runs at 1500 and 1800 psi were measured and plotted as a function of $H_2$ consumption in FIG. 8. The extent of $H_2$ consumed by tar has a substantial impact on the upgraded tar product density. As the $H_2$ consumption was increased by 65% (from 1750 to 2880 scf $H_2$ per barrel of tar) as result of elevated reactor pressure and higher residence time, the density of the upgraded tar product (SATC product) had a sharp decline as shown in FIG. 8.

Figure 10:
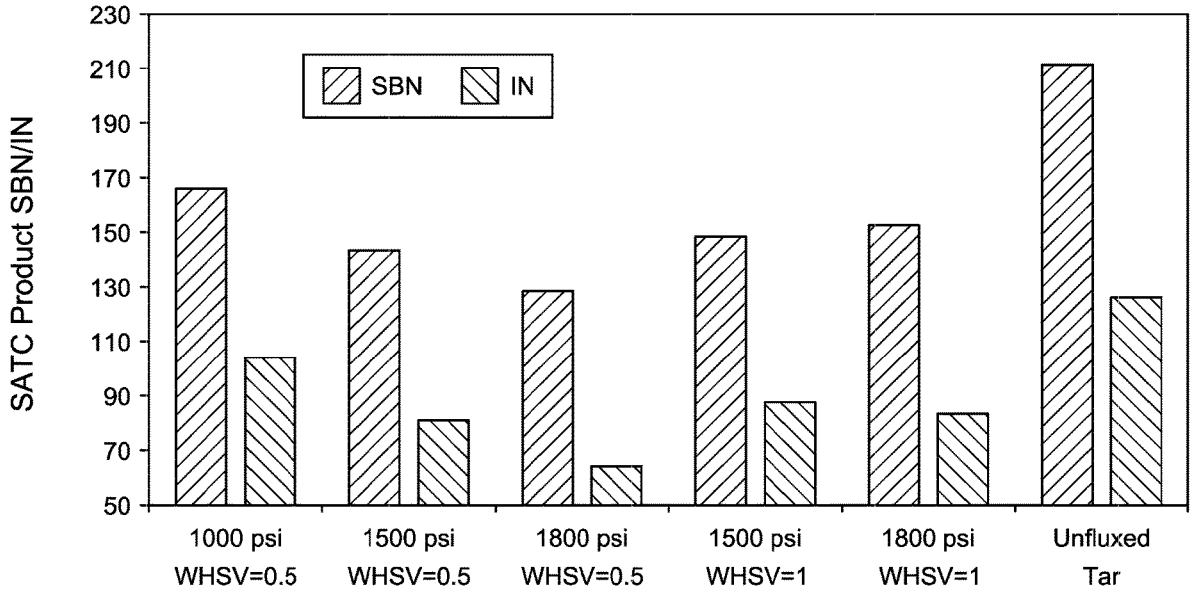
FIG. 10 shows the $S_{BN}$ and $I_N$ values for the raw (unfluxed) tar and for the upgraded hydroprocessed tar products of Example 1 at various WHSV and pressure conditions.

The upstream pressure and the pressure difference between the inlet and outlet of the reactors are monitored during the lifetime of the reactors as shown in FIGS. 10 (*a*) and 10 (*b*). The pressure profiles of the reactors were constant and stable from start-up and no indication of plugging was observed for the first 95 days of the runs. One of the biggest concerns at the start-up of the high pressure runs (>1500 psig) was the reactor plugging due to incompatibility. Since hydrogenation is favored at higher pressures, there was a risk of over saturation of the aromatic rings which will reduce the SBN number of the reactor effluent. If the asphaltenes conversion is not fast enough, the IN will not decrease as fast as SBN decrease. When SBN and IN approaches each other more than 20 units, there is a high risk of precipitation of asphaltenes. Since both of the high pressure runs had no sign of pressure increase over 90 days, elevated pressure runs were effective at reducing the product density without pre-mature reactor plugging problems.

FIG. 10 shows the $S_{BN}$ and $I_N$ pairs for the raw (unfluxed) tar and also SATC products at various conditions. The first three pairs show the impact of increased pressure from 1000 psig (6996 kPa-a) to 1800 psig (12512 kPa-a) holding WHSV at 0.5 $hr^{-1}$. As the pressure was increased, the $I_N$ numbers of the SATC products were significantly reduced. Operating the SATC reactor at elevated pressures is an extremely effective way to reduce the amount asphaltenes with high $I_N$ numbers. In addition, two more data pairs for WHSV=1 $hr^{-1}$ were included as well for the effect of residence time on compatibility at elevated pressures in FIG. 10. As the residence time was decreased at higher flow rates (WHSV=1 $hr^{-1}$), convective flow rate was competing with the reaction rates of hydrogenation and cracking. Thus, less of the asphaltenes are converted at shorter residence time and the $I_N$ numbers were higher. The $S_{BN}$ numbers are also decreasing depending on the extent of hydrogenation and cracking reactions due to increased pressure and increased residence time. More importantly, the decrease in the $S_{BN}$ and $I_N$ were progressing in parallel as shown in FIG. 10 as the pressure was increased and this parallel decrease in both of the compatibility indexes prevented the reactor plugging at elevated pressures.

Example 2

Another series of tar hydroprocessing experiments were conducted at 400° C. and 3:1 ratio of $H_2$ per barrel of feed as in Example 1 and at various pressures from 500 psig (6996 kPa-a) to 1800 psig (12512 kPa-a) and various WHSV values from 0.3 to 1 $hr^{-1}$. The tar employed was the same steam cracker tar as in Example 1. The utility fluid was formed in the same manner as Example 1. The results are summarized in FIGS. 11 to 16.

Figure 11:
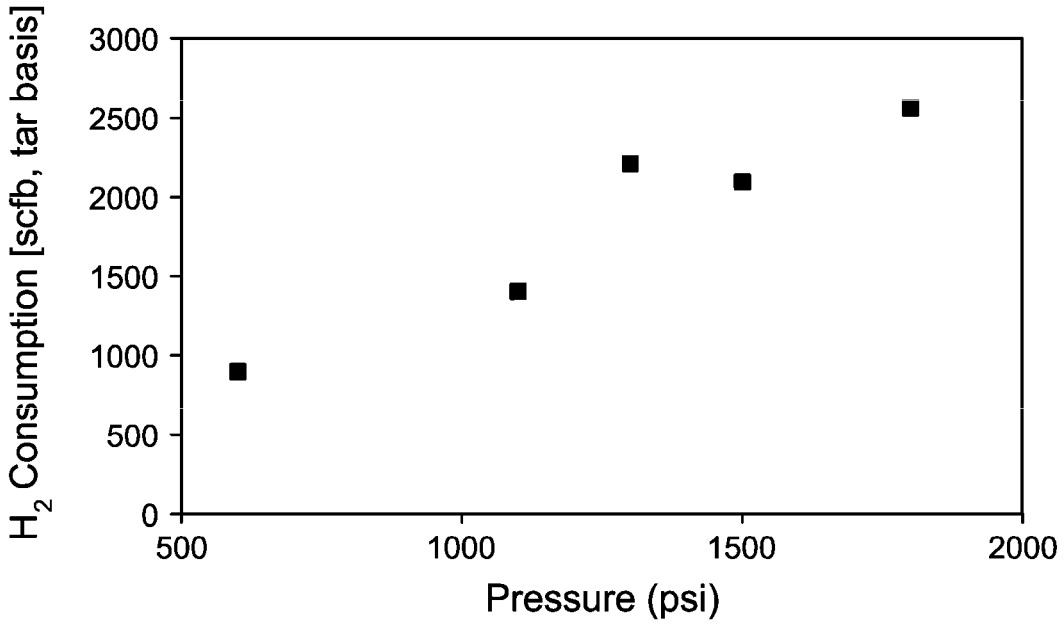
FIG. 11 is a graph of hydrogen consumption against pressure for the hydroprocessing tests of Example 2 at WHSV of 0.5 $hr^{-1}$.
Figure 12:
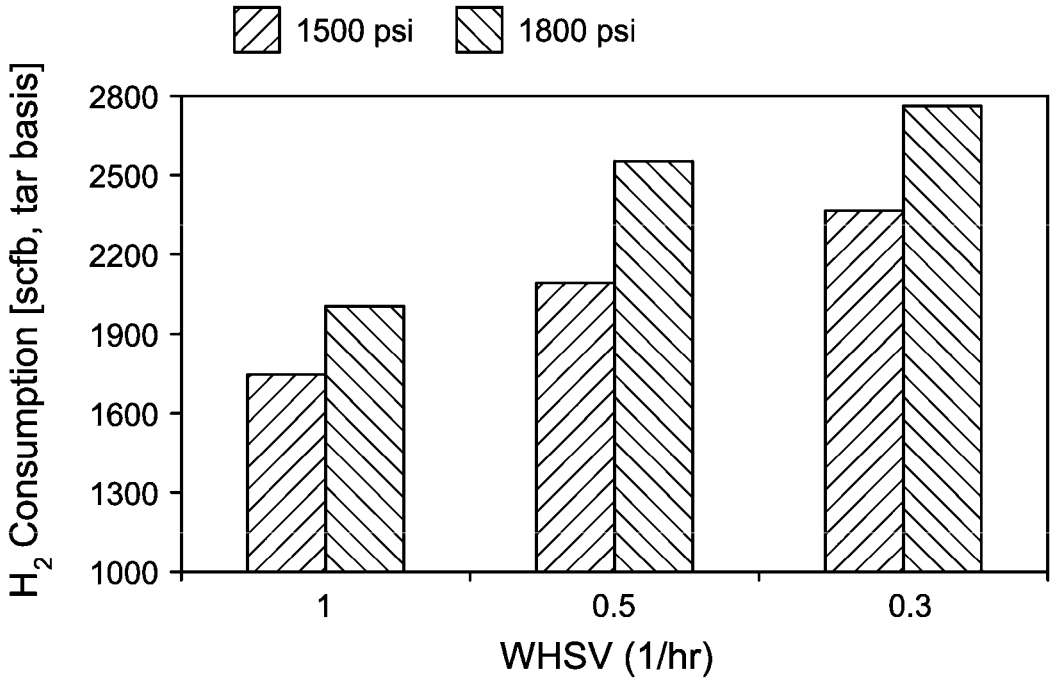
FIG. 12 is a graph of hydrogen consumption against WHSV for the hydroprocessing tests of Example 2 at pressures of 1500 psig (10443 kPa-a) and 1800 psig (12512 kPa-a).

It will be seen from FIG. 11 that hydrogen consumption increases with operating pressure at WHSV of 0.5 $hr^{-1}$. Additionally, FIG. 12 shows that at an operating pressure of 1800 psig (12512 kPa-a) hydrogen consumption increases with decrease in WHSV from 1 $hr^{-1}$ to 0.3 $hr^{-1}$.

Figure 13:
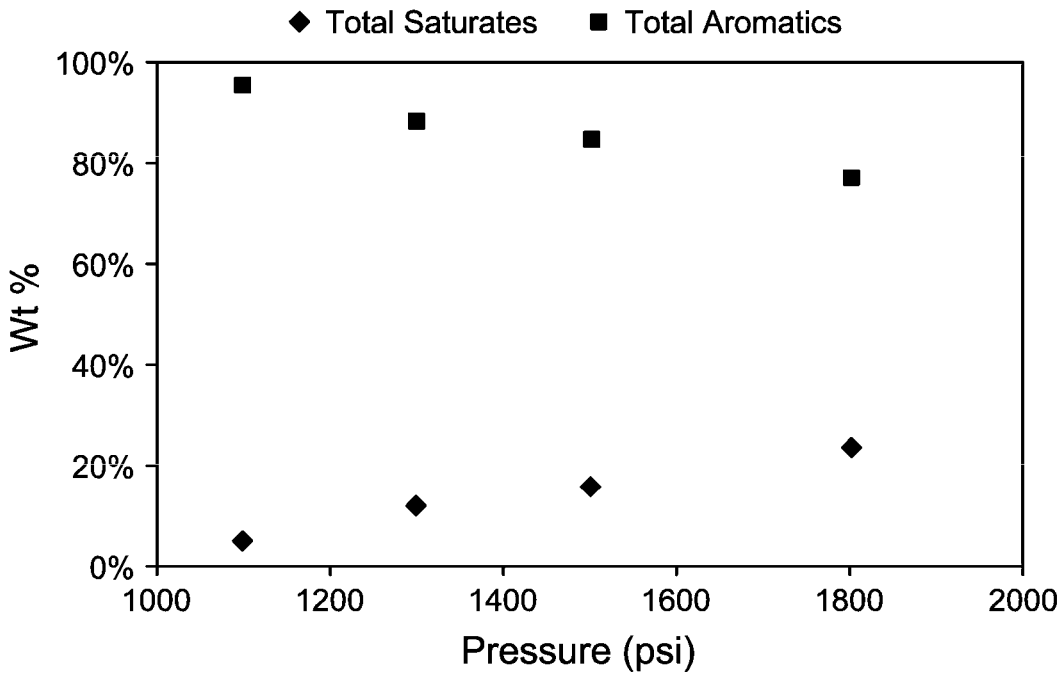
FIG. 13 shows the distribution between saturated and aromatic molecules in the recycled utility fluid at various pressures in the hydroprocessing tests of Example 2 at WHSV of 0.5 $hr^{-1}$.
Figure 14:
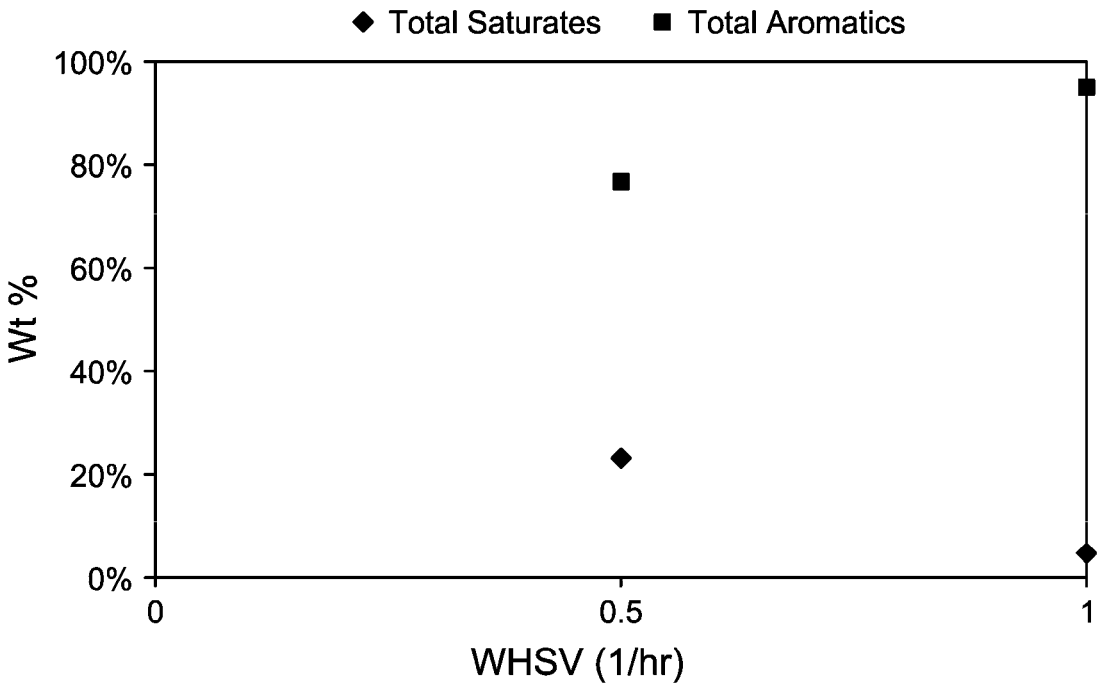
FIG. 14 shows the distribution between saturated and aromatic molecules in the recycled utility fluid at various WHSV values in the hydroprocessing tests of Example 2 at a pressure of 1800 psig (12512 kPa-a).

FIG. 13 shows the distribution of molecules in the recycled utility fluid obtained from hydroprocessing steam cracker tar at pressure ranging from 1100 psi-1800 psi at WHSV of 0.5 $hr^{-1}$. Paraffinic and naphthenic molecules resulting from excess hydrogenation of solvent are classified as total saturates. Aromatic molecules ranging from 1.0-3.5 rings are classified as total aromatics. With increase in pressure from 1100 psi to 1800 psi, total saturates increased from 5% to 23% and total aromatics decreased from 95% to 77%. Similarly, FIG. 14 shows that the saturates content of the recycled utility fluid increased from 5% to 23% and the aromatic content decreased from 95% to 77% with decrease in WHSV from 1 $hr^{-1}$ to 0.5 $hr^{-1}$ at an operating pressure of 1800 psig (12512 kPa-a).

Figure 15:
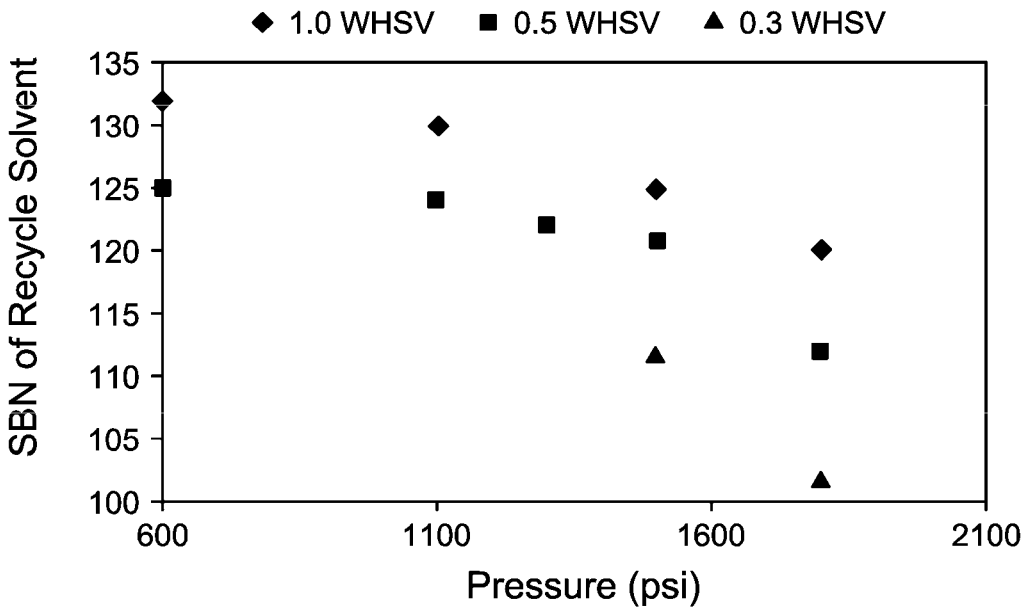
FIG. 15 is a graph showing the SBN values of the recycled utility fluid at various pressures and WHSV values in the hydroprocessing tests of Example 2.

The increase in saturates content of solvents at higher pressure and lower WHSV decreases its solvency power, commonly defined by Solubility Blending Number (SBN). The SBN of recycle solvents at higher pressure and lower WHSV dropped below 120 and up to 100 (FIG. 15). This led to incompatibility in the reactor resulting into reactor fouling.

Figure 16A:
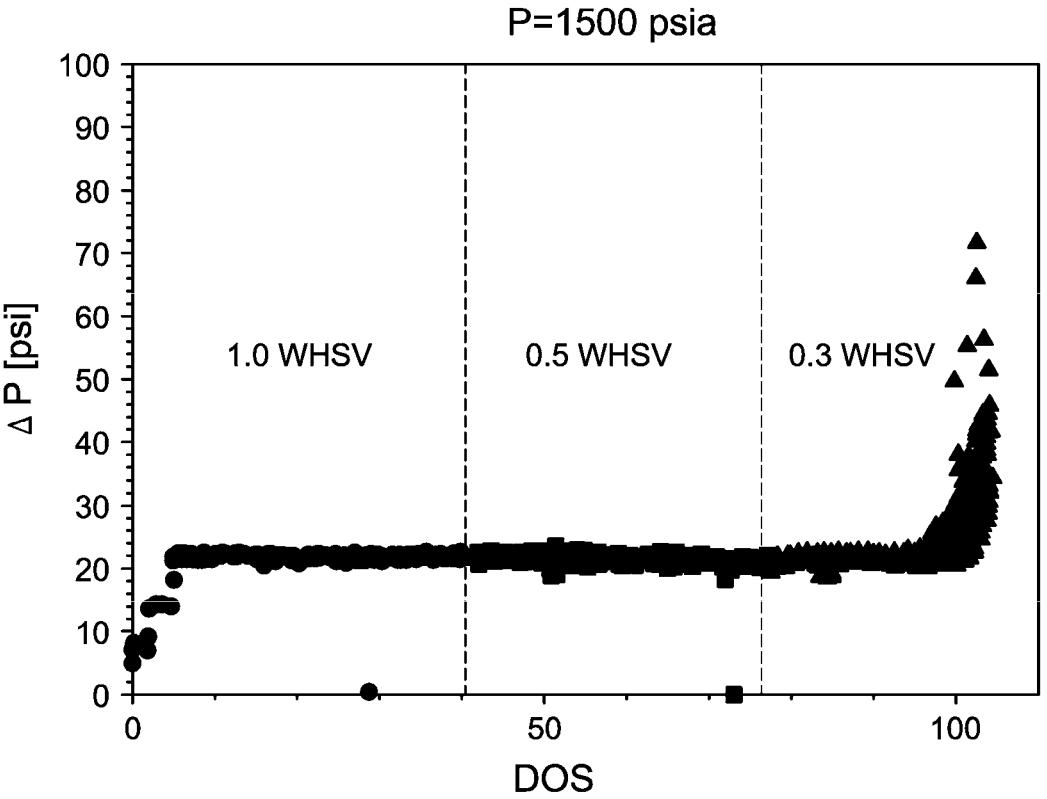
FIGS. 16 (*a*) and (*b*) are graphs of reactor pressure drop against days on stream at various WHSV values in the hydroprocessing tests of Example 2 at pressures of 1500 psig (10443 kPa-a) and 1800 psig (12512 kPa-a), respectively.
Figure 16B:
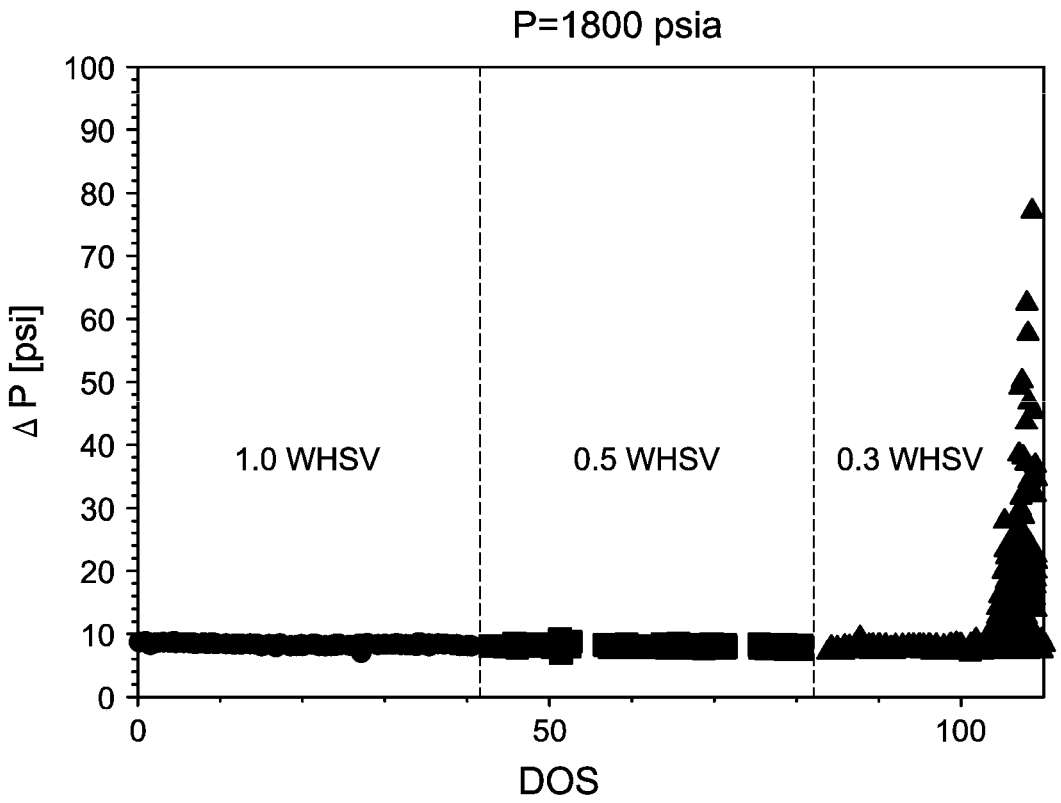

FIGS. 16 (*a*) and (*b*) show the pressure drop over a run time for two reactors ran at 1500 psi and 1800 psi, respectively and different WHSV. When the WHSV was switched to 0.3 $hr^{-1}$ the pressure drop increased exponentially due to fouling and resulted into unit shutdown. The incompatibility in the reactor was evident from the microscope image of product collected from the reactor before the shutdown. The asphaltenes came out of the liquid phase and aggregated.

All patents, test procedures, and other documents cited herein, including priority documents, are fully incorporated by reference to the extent such disclosure is not inconsistent and for all jurisdictions in which such incorporation is permitted.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

When numerical lower limits and numerical upper limits are listed herein, ranges from any lower limit to any upper limit are contemplated.

The invention claimed is:

1. A hydrocarbon conversion process, comprising:

(a) providing a pyrolysis feedstock comprising ≥10.0 wt. % hydrocarbon based on the weight of the pyrolysis feedstock;

(b) pyrolysing the pyrolysis feedstock to produce a pyrolysis effluent comprising pyrolysis tar and ≥1.0 wt. % of $C_2$ unsaturates, based on the weight of the pyrolysis effluent;

(c) separating at least a portion of the pyrolysis tar from the pyrolysis effluent;

(d) combining at least a portion of the separated pyrolysis tar with a utility fluid, the utility fluid comprising aromatic hydrocarbons and having an ASTM D86 10% distillation point ≥60° C. and a 90% distillation point ≤425° C.; and, (e) hydroprocessing the combined pyrolysis tar and utility fluid in at least one hydroprocessing zone in the presence of treatment gas comprising molecular hydrogen under catalytic hydroprocessing conditions to produce a hydroprocessed effluent comprising hydroprocessed tar, wherein the hydroprocessing conditions comprise a molecular hydrogen partial pressure >8 MPa and a weight hourly space velocity of combined pyrolysis tar and utility fluid >0.3 $hr^{-1}$.

2. The process of claim 1, wherein the hydroprocessing conditions comprise a molecular hydrogen partial pressure ≤14 MPa.

3. The process of claim 1, wherein the hydroprocessing conditions comprise a weight hourly space velocity of combined pyrolysis tar and utility fluid ≤5 $hr^{-1}$.

4. The process of claim 1, wherein the hydroprocessing conditions are selected such that the molecular hydrogen consumption rate is in the range of 270 to 445 standard cubic meters/cubic meter (S $m^3/m^3$) of pyrolysis tar.

5. The process of claim 1, further comprising the steps:

separating from the hydroprocessed effluent (i) an overhead stream, (ii) a bottoms stream, and (iii) a side stream; and (g) conducting at least a portion of the side stream to step (d), wherein the utility fluid comprises ≥10.0 wt. % of the side stream, based on the weight of the utility fluid.

6. The process of claim 1, wherein the separated pyrolysis tar has $I_N$>80 and >70 wt. % of the pyrolysis tar's molecules have an atmospheric boiling point of ≥290° C.

7. The process of claim 6, wherein the separated pyrolysis tar has $I_N$>100.

8. The process of claim 1, where the density of the hydroprocessed tar measured at 15° C. is at least 0.10 g/$cm^3$ less than the density of the separated pyrolysis tar.

9. The process of claim 1, wherein the density of the separated pyrolysis tar measured at 15° C. is ≥1.10 g/$cm^3$ and the density of the hydroprocessed tar measured at 15° C. is at least 0.10 g/$cm^3$ less than the density of the separated pyrolysis tar.

10. The process of claim 1, wherein the utility fluid has a $S_{BN}$≥100.

11. The process of claim 1, wherein the combined pyrolysis tar and utility fluid has a $S_{BN}$≥110.

12. The process of claim 1, wherein the utility fluid has a true boiling point distribution having (i) an initial boiling point ≥130° C., and (ii) a final boiling point ≤566° C.

13. The process of claim 1, wherein the viscosity of the hydroprocessed tar measured at 50° C. is <200 cSt.

14. The process of claim 1, wherein the utility fluid comprises ≥15 wt % two ring and/or three ring aromatic compounds.

15. The process of claim 1, wherein the pyrolysis feedstock hydrocarbon comprises one or more of naphtha, gas oil, vacuum gas oil, waxy residues, atmospheric residues, residue admixtures, or crude oil.

16. A hydrocarbon conversion process comprising:

(a) providing a pyrolysis feedstock comprising ≥10.0 wt. % hydrocarbon based on the weight of the pyrolysis feedstock;

(b) pyrolysing the pyrolysis feedstock to produce a pyrolysis effluent comprising pyrolysis tar and ≥1.0 wt. % of $C_2$ unsaturates, based on the weight of the pyrolysis effluent;

(c) separating at least a portion of the pyrolysis tar from the pyrolysis effluent;

(d) combining at least a portion of the separated pyrolysis tar with a utility fluid, the utility fluid comprising aromatic hydrocarbons and having an ASTM D86 10% distillation point ≥60° C. and a 90% distillation point ≤425° C.; and (e) hydroprocessing the combined pyrolysis tar and utility fluid in at least one hydroprocessing zone in the presence of treatment gas comprising molecular hydrogen under catalytic hydroprocessing conditions to produce a hydroprocessed effluent comprising hydroprocessed tar, wherein the hydroprocessing conditions comprise a molecular hydrogen partial pressure >8 Mpa and are selected such that the molecular hydrogen consumption rate is in the range of 270 to 445 standard cubic meters/cubic meter (S $m^3/m^3$) of pyrolysis tar.

17. The process of claim 16, wherein the hydroprocessing conditions comprise a weight hourly space velocity of combined pyrolysis tar and utility fluid >0.3 $hr^{-1}$.

18. The process of claim 16, where the density of the hydroprocessed tar measured at 15° C. is at least 0.10 g/$cm^3$ less than the density of the separated pyrolysis tar wherein.

19. The process of claim 16, wherein the separated pyrolysis tar has $I_N$>80 and >70 wt. % of the pyrolysis tar's molecules have an atmospheric boiling point of ≥290° C.

20. The process of claim 16, wherein the separated pyrolysis tar has $I_N$>100.

21. The process of claim 16, wherein ≥90 wt. % of the pyrolysis tar's molecules have an atmospheric boiling point of ≥290° C.

22. The process of claim 16, where the density of the separated pyrolysis tar measured at 15° C. is ≥1.10 g/$cm^3$ and the density of the hydroprocessed tar measured at 15° C. is at least 0.10 g/$cm^3$ less than the density of the separated pyrolysis tar.

23. The process of claim 16, wherein the utility fluid has a $S_{BN}$≥100.

24. The process of claim 16, wherein the combined pyrolysis tar and utility fluid has a $S_{BN}$≥110.

25. The process of claim 16, wherein the utility fluid has a true boiling point distribution having (i) an initial boiling point ≥130° C., and (ii) a final boiling point ≤566° C.

26. The process of claim 16, wherein the utility fluid comprises ≥15 wt % two ring and/or three ring aromatic compounds.

27. The process of claim 16, wherein the viscosity of the hydroprocessed tar measured at 50° C. is <200 cSt.

* * * * *